US010123933B2

(12) United States Patent
Shao

(10) Patent No.: US 10,123,933 B2
(45) Date of Patent: Nov. 13, 2018

(54) MODULAR MALE SEXUAL AID DEVICE AND METHOD OF ASSEMBLING SAME

(71) Applicant: Polydigitech Inc., Arlington Heights, IL (US)

(72) Inventor: Ben C. Shao, Clarendon Hills, IL (US)

(73) Assignee: Polydigitech Inc., Arlington Heights, IL (US)

( * ) Notice: Subject to any disclaimer, the term of this patent is extended or adjusted under 35 U.S.C. 154(b) by 10 days.

(21) Appl. No.: 15/282,784

(22) Filed: Sep. 30, 2016

(65) Prior Publication Data

US 2018/0092798 A1 Apr. 5, 2018

(51) Int. Cl.
*A61H 19/00* (2006.01)

(52) U.S. Cl.
CPC ..... *A61H 19/32* (2013.01); *A61H 2205/087* (2013.01)

(58) Field of Classification Search
CPC ..... A61H 19/00; A61H 19/32
USPC ..... 600/38–41
See application file for complete search history.

(56) References Cited

U.S. PATENT DOCUMENTS

| | | | | |
|---|---|---|---|---|
| 5,782,818 | A | 7/1998 | Shubin | |
| 5,807,360 | A | 9/1998 | Shubin | |
| 5,997,469 | A | 12/1999 | Northcutt | |
| 7,108,668 | B2 | 9/2006 | Fang | |
| 7,566,299 | B2 * | 7/2009 | Montgomery | A61F 5/41 600/38 |
| 7,993,315 | B2 * | 8/2011 | Matsuura | A61B 10/0058 600/38 |
| 8,353,887 | B2 | 1/2013 | Matsuura | |
| 8,475,422 | B2 * | 7/2013 | Wu | A61B 10/0058 600/38 |
| 8,556,837 | B1 | 10/2013 | Poirier | |
| 9,138,372 | B2 | 9/2015 | Dorronsoro Rueda | |
| 2007/0129599 | A1 | 6/2007 | Nan | |
| 2009/0234182 | A1 | 9/2009 | Buchholz | |
| 2013/0226054 | A1 | 8/2013 | Smith | |
| 2013/0289345 | A1 | 10/2013 | Dorronsoro Rueda | |
| 2013/0345501 | A1 | 12/2013 | O'Reilly | |

FOREIGN PATENT DOCUMENTS

DE 102011013729 9/2012

* cited by examiner

*Primary Examiner* — Samuel Gilbert
(74) *Attorney, Agent, or Firm* — Leydig, Voit & Mayer, Ltd.

(57) ABSTRACT

A modular male sexual aid device includes a housing, a plurality of ring segments, and an end cap. The housing includes a base and a pair of walls. Each of the walls extends longitudinally between a bottom end and a top end. Each ring segment is removably connected to one of the walls of the housing such that the central passages of the ring segments define a masturbation passage. At least one of the walls of the housing can be pivotally mounted to the base such that it is movable between an upright assembled position and an outwardly extending disassembled position. The end cap is removably connected to the top ends of the walls such that the walls are prevented from rotating outwardly away from each other.

20 Claims, 23 Drawing Sheets

MODULAR MALE SEXUAL AID DEVICE AND METHOD OF ASSEMBLING SAME

TECHNICAL FIELD

This patent disclosure relates generally to a male sexual aid device and, more particularly, to a modular male sexual aid device.

BACKGROUND

Sex toys are devices that are primarily used to stimulate human sexual organs. The stimulation through a sex toy may be achieved through self stimulation, or alternatively, stimulation by another. A sex toy for males generally consists of an object that causes friction or vibration on a penis.

U.S. Pat. No. 9,138,372 (the '372 Patent) is directed to a male masturbation aid. The '372 patent describes a male masturbating device that includes a plurality of rings fixed together by coupling parts. The fixed-together rings form a tubular body with an orifice for introducing a penis to perform a masturbating act. Each ring is coupled directly to an adjacent ring to form the tubular body. Each ring has an internal section with a design different from the design of the internal section of each of the other rings.

It will be appreciated that this background description has been created by the inventor to aid the reader, and is not to be taken as an indication that any of the indicated problems were themselves appreciated in the art. While the described principles can, in some aspects and embodiments, alleviate the problems inherent in other systems, it will be appreciated that the scope of the protected innovation is defined by the attached claims, and not by the ability of any disclosed feature to solve any specific problem noted herein.

BRIEF SUMMARY

The present disclosure is directed to embodiments of a modular male sexual aid device and methods of assembling the same. In one embodiment, the disclosure describes a modular male sexual aid having a housing, a plurality of ring segments, and an end cap.

The housing includes a base and a pair of walls. Each of the walls extends longitudinally between a bottom end and a top end. The bottom ends of the walls are connected to the base. One of the walls includes an interior wall surface that defines a plurality of retention pockets along the interior wall surface.

Each ring segment of the plurality of ring segments has an outer circumferential sidewall, a body, an inner circumferential sidewall, and a retention mechanism. The body extends radially between the outer circumferential sidewall and the inner circumferential sidewall, the inner circumferential sidewall defining a central passage extending along a ring axis. The retention mechanism extends outward radially from the outer circumferential sidewall, the retention mechanism being adapted to retentively engage one of the retention pockets of the housing to removably mount the respective ring segment to the housing.

The end cap is removably connected to the top ends of the walls of the housing. The ring segments are removably mounted to the housing by the respective retention mechanisms such that the central passages of the ring segments are substantially aligned with each other to define a masturbation passage. The masturbation passage has an open end adjacent the top ends of the walls and is configured for performing a masturbating act.

In another embodiment, the disclosure describes a modular male sexual aid device that includes a housing, a plurality of ring segments, and an end cap. The housing includes a base and a pair of walls. Each of the walls extends longitudinally between a bottom end and a top end. The bottom ends of the walls are pivotally connected to the base. The walls are in opposing relationship to each other about the base.

Each ring segment of the plurality of ring segments defines a central passage extending along a ring axis. Each ring segment is removably connected to one of the walls of the housing such that the central passages of the ring segments define a masturbation passage.

The end cap is removably connected to the top ends of the walls such that the walls are prevented from rotating outwardly away from each other. When the end cap is removed from the housing, the walls are each pivotally movable over a range of travel about a respective hinge axis between an upright position in which said wall is in substantially perpendicular relationship with the base and a prone position in which said wall extends outwardly from the base.

In yet another aspect, the disclosure describes an embodiment of a method of assembling a modular male sexual aid device. The method includes removably mounting a plurality of ring segments to a first wall of a housing. Each ring segment defines a central passage extending along a ring axis. The first wall is pivotally moved to an upright position in which the first wall is in substantially perpendicular relationship with the base. The first wall is positioned with respect to a second wall of the housing such that the ring segments are interposed between the first wall and the second wall. An end cap is removably mounted to top ends of the first and second walls such that the first wall is prevented from rotating outwardly with respect to the second wall. The central passages of the ring segments are substantially aligned with each other to define a masturbation passage. The masturbation passage has an open end adjacent the top ends of the walls, the open end being configured for performing a masturbating act.

Further and alternative aspects and features of the disclosed principles will be appreciated from the following detailed description and the accompanying drawings. As will be appreciated, the modular male sexual aid devices and methods disclosed herein are capable of being carried out in other and different embodiments, and capable of being modified in various respects. Accordingly, it is to be understood that both the foregoing general description and the following detailed description are exemplary and explanatory only and do not restrict the scope of the appended claims.

It should be understood that the drawings are not necessarily to scale and that the disclosed embodiments (or features thereof) are illustrated diagrammatically and in partial views. In certain instances, details which are not necessary for an understanding of this disclosure or which render other details difficult to perceive may have been omitted. It should be understood that this disclosure is not limited to the particular embodiments illustrated herein.

DETAILED DESCRIPTION

The present disclosure provides various embodiments of a modular male sexual aid device and a method of assembling a modular male sexual aid device including a plurality of ring segments that can be arranged in a selected order to define a masturbation passage suitable for performing a male sex act. In embodiments, at least one of the ring segments can be different from the other ring segments. In embodiments, at least one of the ring segments has at least one of a shape and a texture that is different from that of the other ring segments. A user can assemble the modular male sexual aid device in a variety of possible ring segment arrangements in order to change the configuration of the masturbation passage defined by the ring segments. It should be understood that reference to "masturbation" herein contemplates the use of the sexual aid device either by a person on his own genitals or on another person's genitals.

Figure 1:
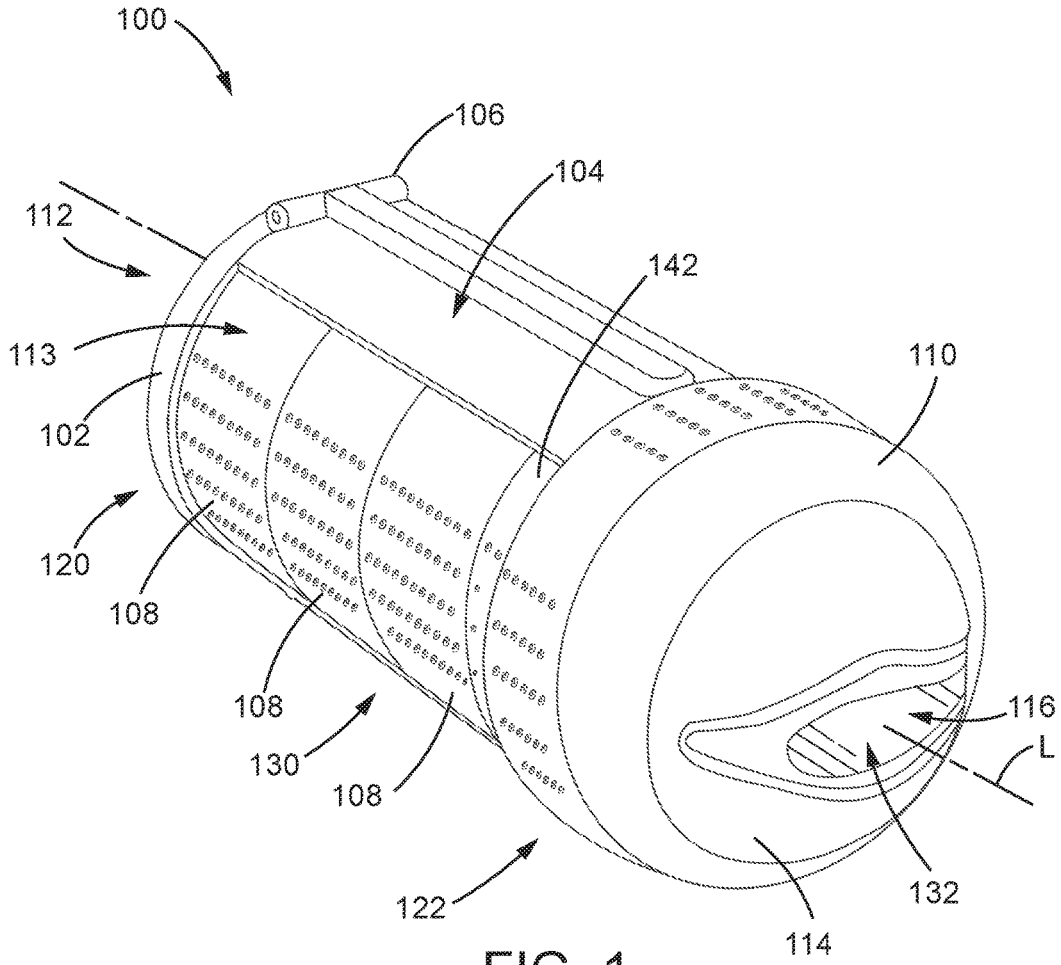
FIG. 1 is a top perspective view of an embodiment of a modular male sexual aid device constructed in accordance with principles of the present disclosure.

Turning now to the Figures, there is shown in FIG. 1 an embodiment of a modular male sexual aid device 100 constructed according to principles of the present disclosure. The modular male sexual aid device 100 includes a housing 112, a plurality of ring segments 108, 142, and an end cap 110.

The housing is adapted 112 to house the ring segments 108, 142 in one of a variety of possible axial arrangements. The plurality of ring segments 108, 142 are disposed, at least partially, within the housing 112. The ring segments 108, 142 can be removably mounted to at least a portion of the housing 112. The plurality of ring segments 108, 142 can be arranged with respect to each other to form a tubular body defining a masturbation passage configured for performing a masturbating act. A user can selectively re-arrange the order of the ring segments 108, 142 and re-mount them to the housing 112 to provide a masturbation passage 132 with a different configuration.

The end cap 110 can be adapted to be removably mounted to the housing 112 to maintain the housing 112 and the attached ring segments 108, 142 in an assembled condition wherein the ring segments 108, 142 define the masturbation passage 132. A flexible disk 126 can be placed between the base 102 and the ring segment 108 that is adjacent to the base 102 to allow for easy cleanup following the use of the modular male sexual aid device 100 (see e.g. FIG. 8).

Referring to FIG. 1, the housing 112 can be adapted to house the ring segments 108, 142 in a selected axial order, with the ring segments 108 interposed between the top ring segment 142 and the base 102. In the illustrated embodiment, the housing 112 includes a base 102, a first wall 104, and a second wall 130. The first wall 104 and the second wall 130 both extend between a respective bottom end 120 and a top end 122 along a longitudinal axis L. The bottom ends 120 of each of the first wall 104 and the second wall 130 are connected to the base 102. In the illustrated embodiment, the bottom ends 120 of the walls 104, 130 are connected to the base 102 such that the walls 104, 130 are in opposing relationship to each other about the base 102. In embodiments, the housing 112 can be made from a variety of suitable materials, such as a suitably rigid plastic, for example.

Figure 2:
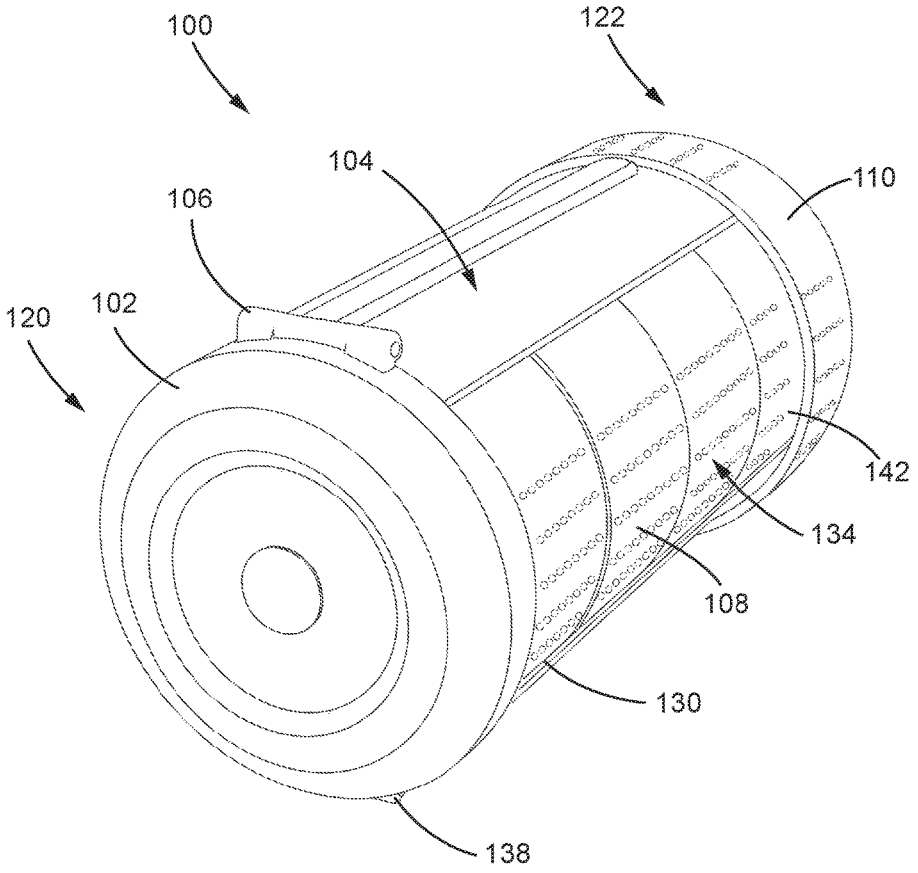
FIG. 2 is a bottom perspective view of the modular male sexual aid device of FIG. 1.
Figure 6:
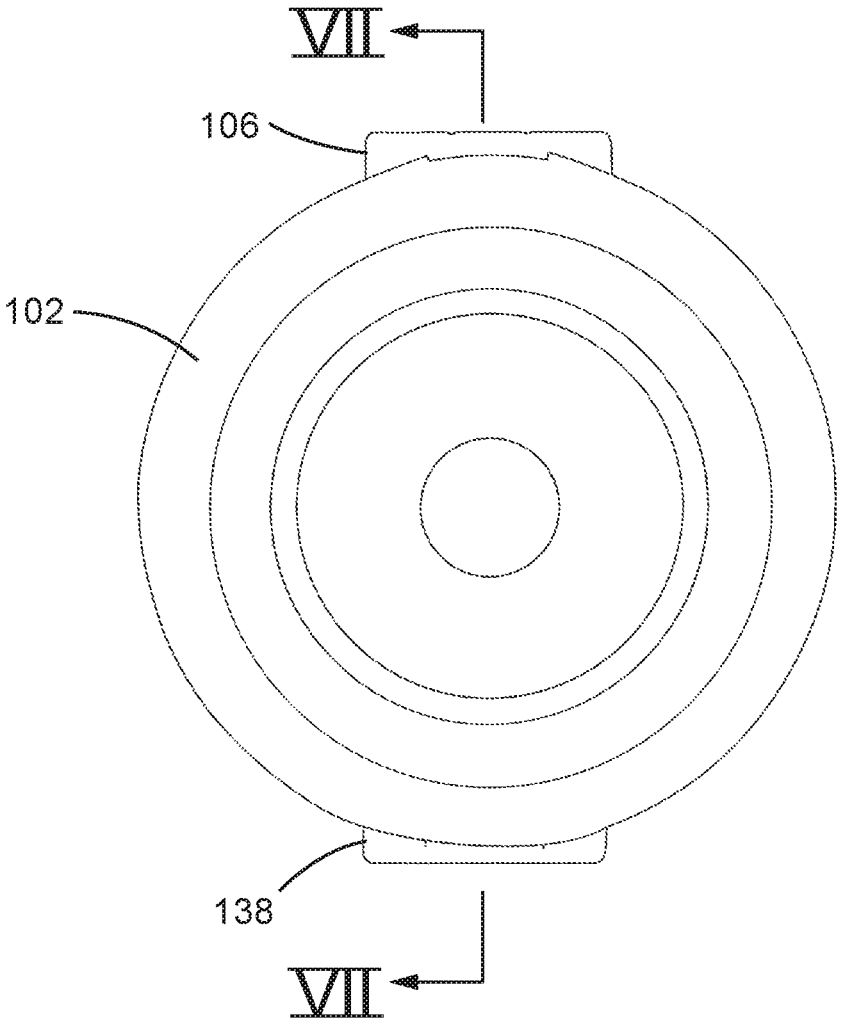
FIG. 6 is a bottom plan view of the modular male sexual aid device of FIG. 1.

In embodiments, at least one of the first wall 104 and the second wall 130 can be pivotally connected to the base 102. In embodiments, at least one of the bottom ends 120 of the walls 104, 130 is hingedly connected to the base 102 such that such wall, when the end cap 110 is removed from the housing 112, is pivotally movable over a range of travel about a hinge axis between an upright position in which said wall is in substantially perpendicular relationship with the base 102 (see, e.g. FIG. 9) and a prone position in which said wall extends outwardly from the base 102 (see, e.g. FIG. 10). In the illustrated embodiment as shown in FIG. 2, the walls 104, 130 of the housing 112 are both hingedly connected to the base 102 such that each wall 104, 130, when the end cap 110 is removed from the housing 112, is pivotally movable about a respective hinge axis between the upright position and the prone position. The first wall 104 is pivotally connected to the base 102 via a first hinge 106 which defines the hinge axis for the first wall 104, and the second wall 130 is pivotally connected to the base 102 via a second hinge 138 which defines the hinge axis for the second wall 130. The first hinge 106 and the second hinge 138 can be in opposing relationship to each other about the base 102 (see e.g. FIG. 6).

Figure 4:
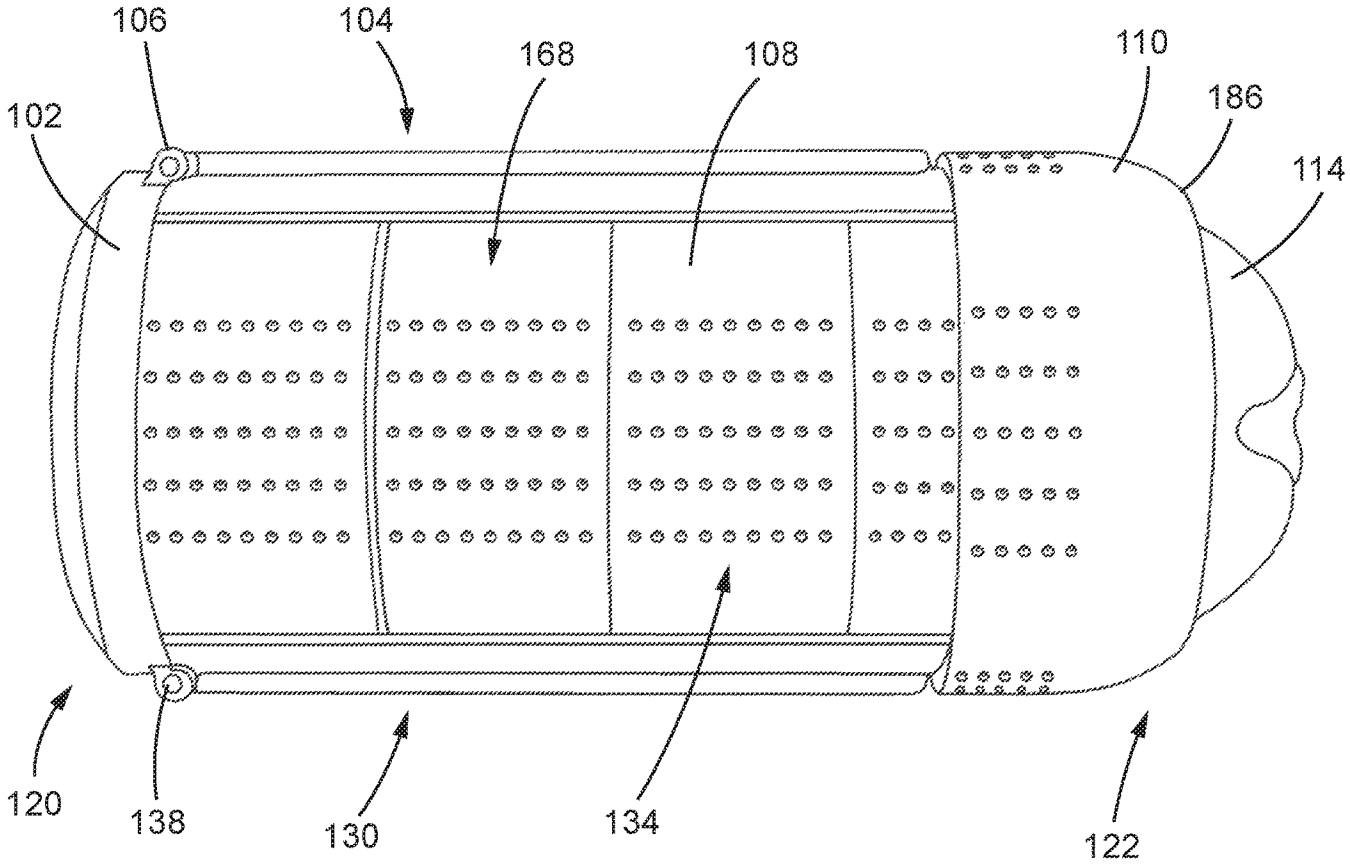
FIG. 4 is a front elevational view of the modular male sexual aid device of FIG. 1. The rear elevational view of the modular male sexual aid device of FIG. 1 is the same as the front elevational view thereof.
Figure 5:
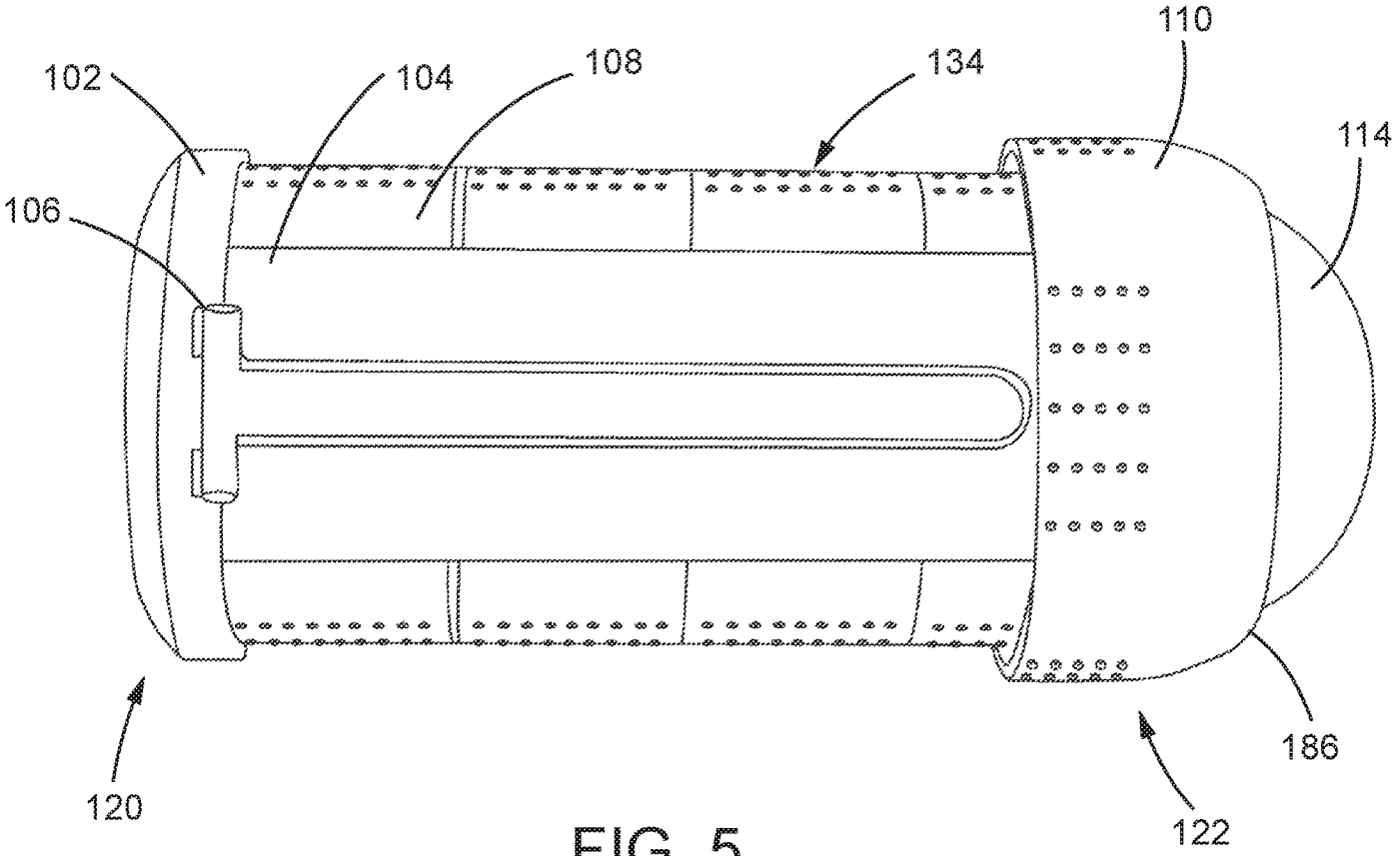
FIG. 5 is a left side elevational view of the modular male sexual aid device of FIG. 1. The right side elevational view of the modular male sexual aid device of FIG. 1 is the same as the left side elevational view thereof.

As shown in FIGS. 4 and 5, the first and second walls 104, 130 partially enclose the plurality of ring segments 108, 142. In other embodiments, the first and second walls 104, 130 can fully enclose the plurality of ring segments 108, 142.

Figure 10:
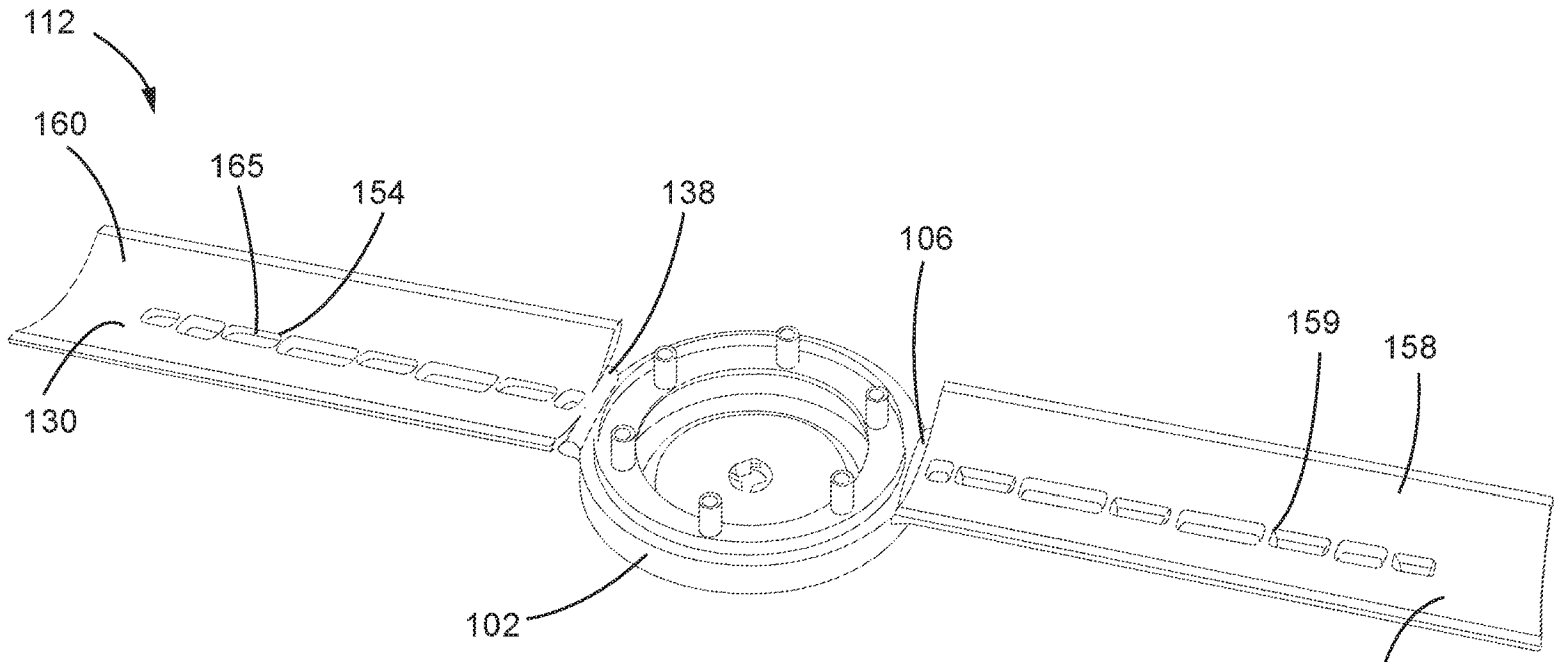
FIG. 10 is another perspective view of the housing of FIG. 9, illustrating the walls of the housing in a prone position.

In embodiments, one of the first and second walls 104, 130 includes an interior wall surface defining a plurality of retention pockets along the interior wall surface. Referring to FIG. 10, the second wall 130 defines a plurality of retention pockets 154 along an interior wall surface 160. Each of the retention pockets 154 of the housing 112 includes a pair of pocket sidewall surfaces 165 in opposing relationship to each other. The plurality of retention pockets 154 are positioned and sized to receive retention mechanisms 198 of the respective plurality of ring segments 108, 142.

Figure 12:
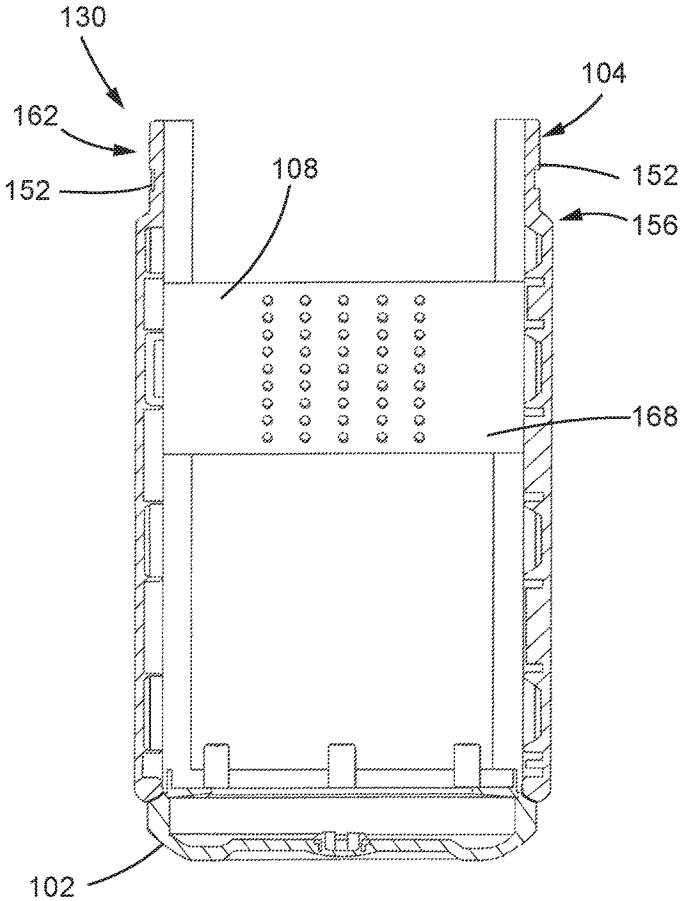
FIG. 12 is a view as in FIG. 11, but in elevation, of the housing of FIG. 9, illustrating a ring segment of the modular male sexual aid device removably connected thereto.
Figure 11:
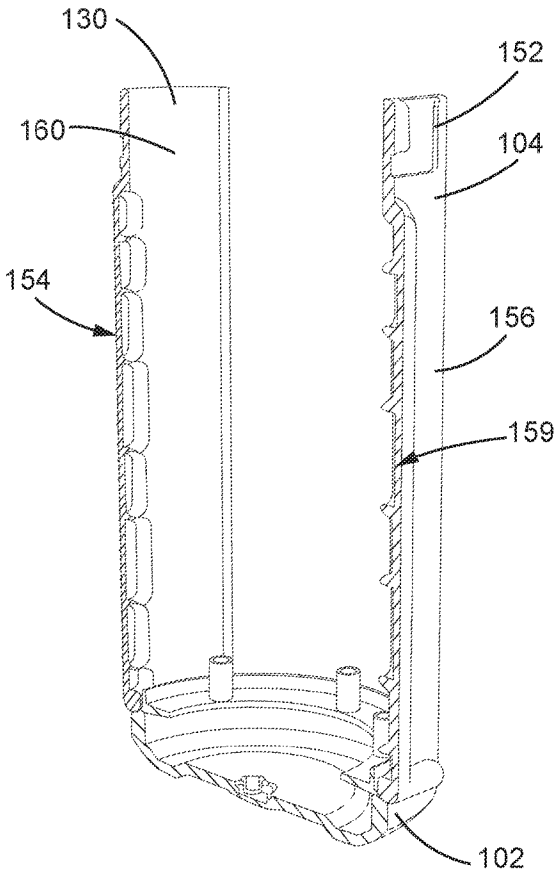
FIG. 11 is a longitudinal sectional view, in perspective, of the housing of FIG. 9.
Figure 13:
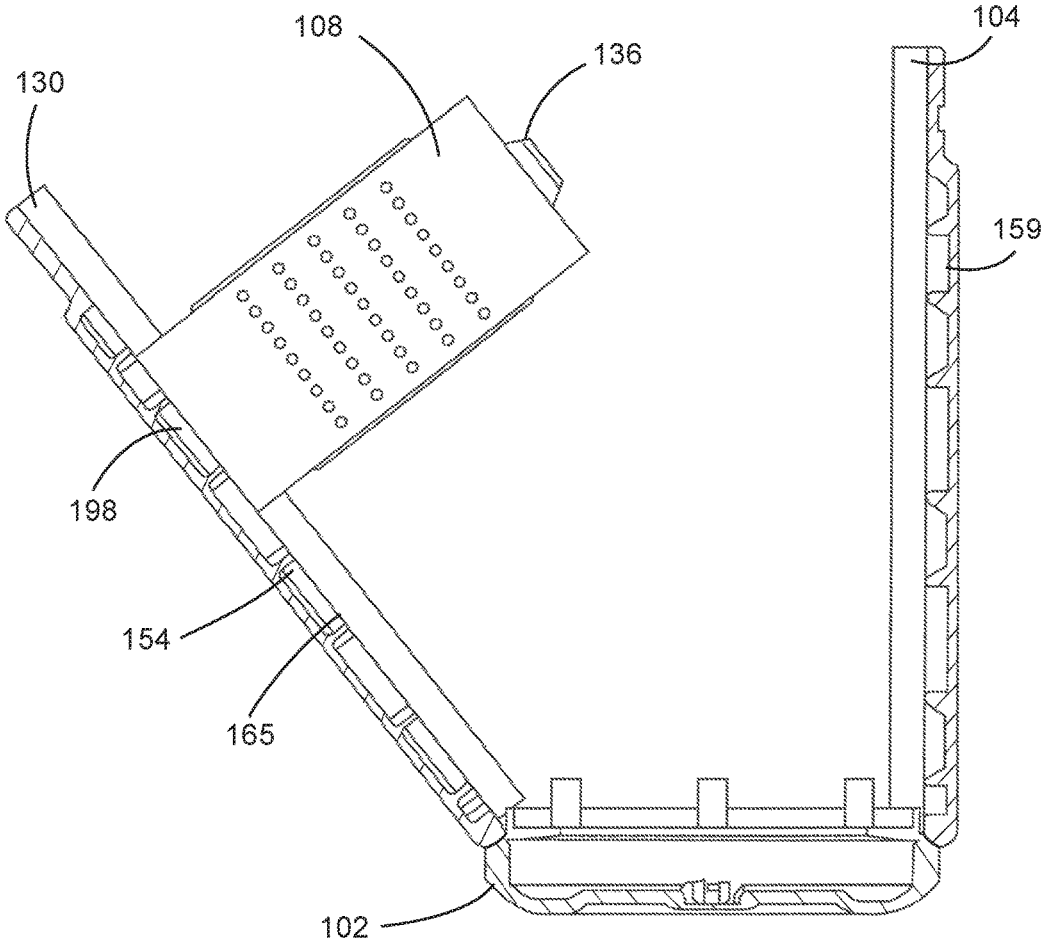
FIG. 13 is a view as in FIG. 12, but illustrating a first wall of the housing in a prone position extending outwardly from a base thereof and a second wall of the housing in an upright position.

In embodiments, the other of the walls 104, 130 includes an interior wall surface defining a plurality of indexing recesses. In the illustrated embodiment, the first wall 104 defines the plurality of indexing recesses 159 along the interior wall surface 158. The indexing recesses 159 are in regular, spaced relation to each other along the interior wall surface 158 of the first wall 104 such that the indexing recesses 159 are respectively aligned with the retention pockets 154 of the second wall 130 (see e.g. FIGS. 11-13). In embodiments, the indexing recesses 159 can be used to house supports projecting from at least one of the ring segments to further maintain the ring segments within the housing 112.

Figure 9:
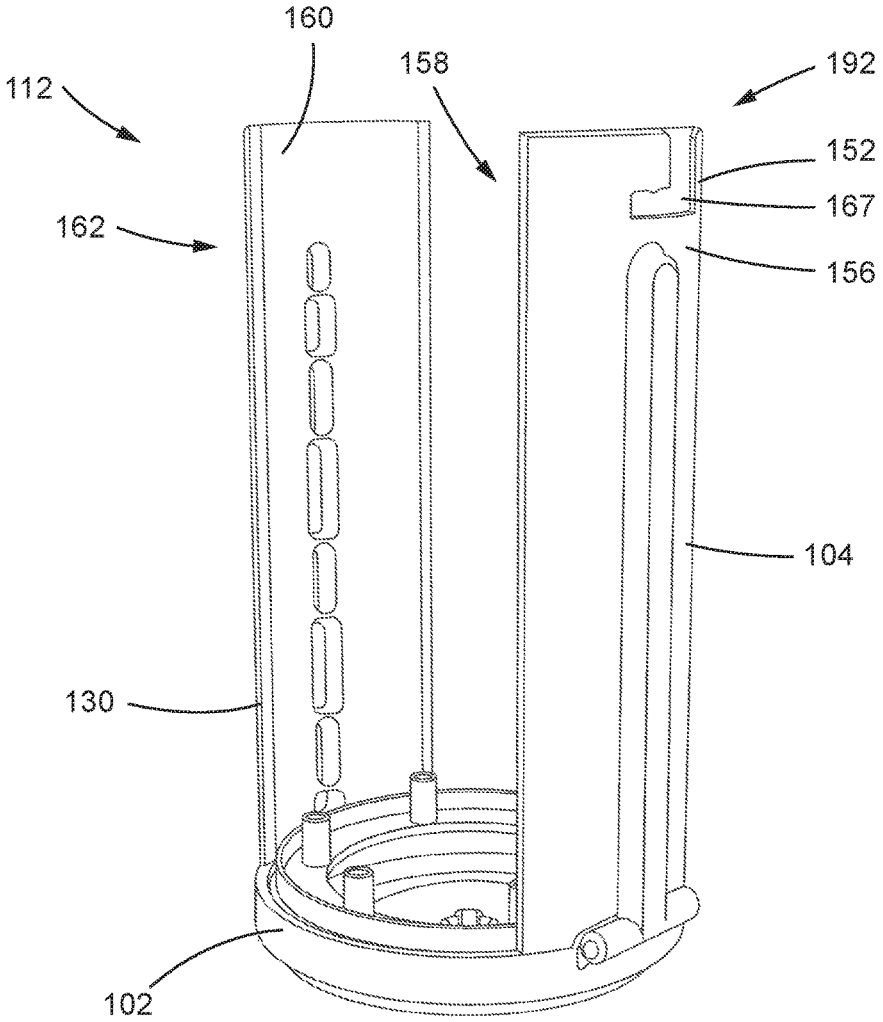
FIG. 9 is a perspective view of a housing of the modular male sexual aid device of FIG. 1, illustrating a pair of walls of the housing in an upright position.

Referring to FIG. 9, at least one of the first wall 104 and the second wall 130 form a retention surface 167 on their respective exterior wall surface 156, 162. The retention surface 167 is configured to interact with the end cap 110 to allow the end cap 110 to be removably mounted to the housing 112. In the illustrated embodiment, the retention surface 167 defines a lug raceway 152 at the top end 122 of the pair of walls 104, 130. Alternatively, at least one of the first wall 104 and the second wall 130 can form a retention surface on their respective interior wall surface 158, 160.

Figure 7:
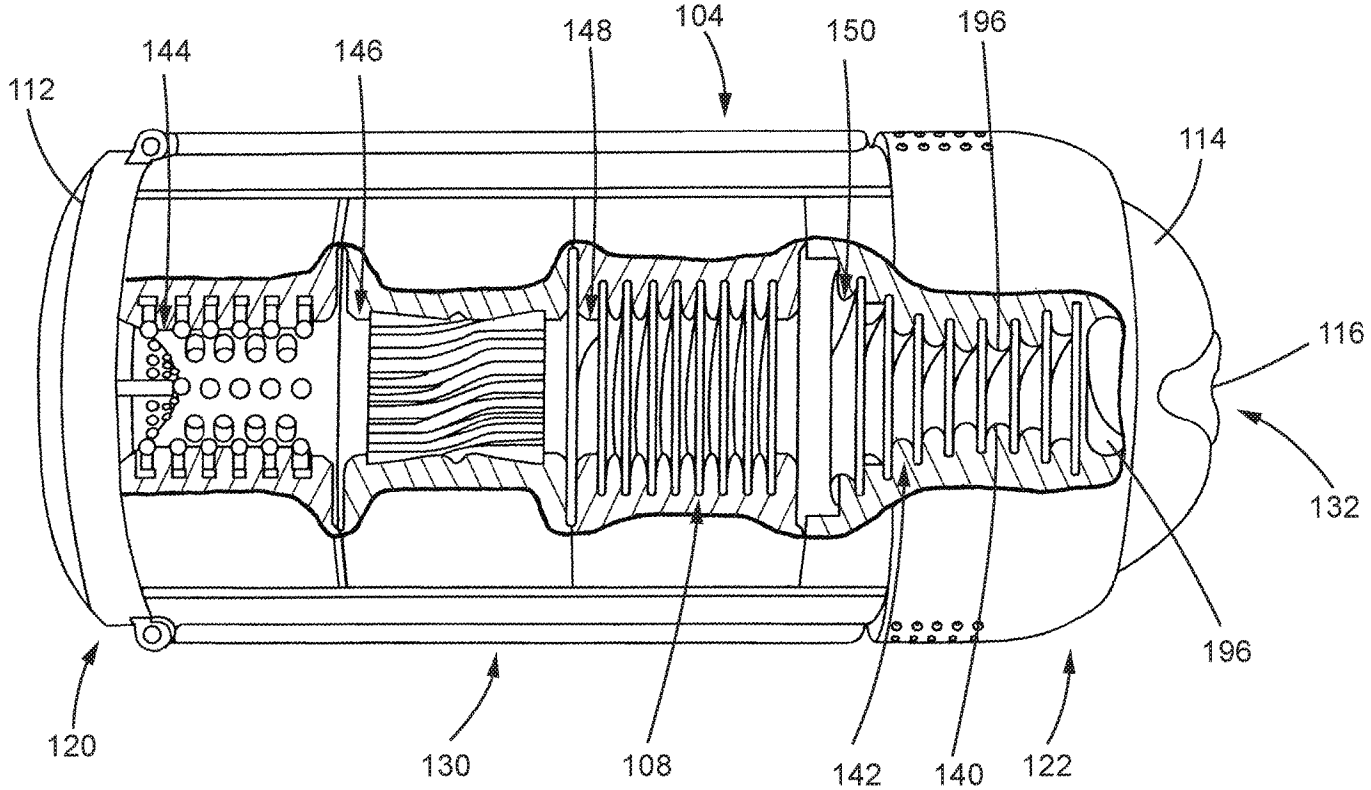
FIG. 7 is a cross-sectional view of the modular male sexual aid device of FIG. 1 taken along line VII-VII in FIG. 6.

Referring to FIG. 7, the modular male sexual aid device 100 includes a plurality of ring segments 108, 142. In the illustrated embodiment, three ring segments 108 are interposed between the base 102 and the top ring segment 142. In other embodiments, the number of ring segments 108 that can be mounted to the housing 112 and/or size of each ring segment 108 can be varied.

The ring segments 108, 142 are disposed between the first wall 104 and the second wall 130. The top ring segment 142 is longer, as measured along the ring axis R, than the other ring segments 108. In embodiments, the top ring segment 142 can be identical in size with the ring segments 108. Each of the ring segments 108, 142 has a similar construction. Accordingly, it should be understood that the description of one ring segment is applicable to any of the other ring segments, as well. In embodiments, an outer diameter of the top ring segment 142 is substantially the same as an outer diameter of the ring segments 108.

Figure 14:
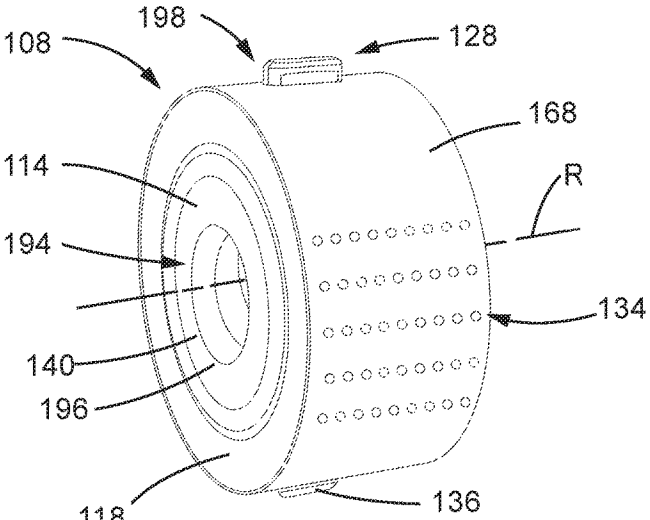
FIG. 14 is a perspective view of a ring segment of the modular male sexual aid device of FIG. 1.
Figure 16:
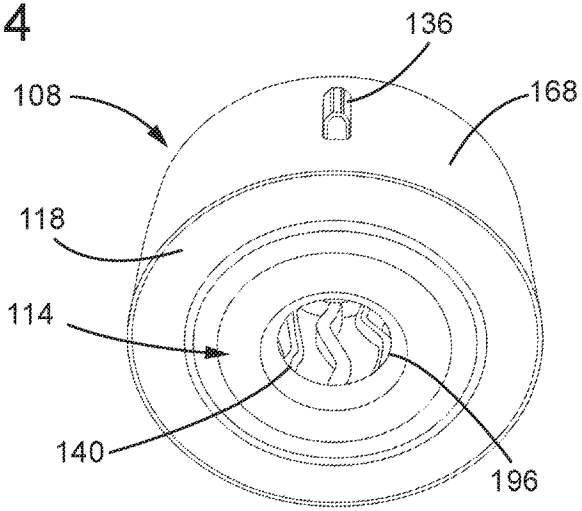
FIG. 16 is a perspective view of still another ring segment of the modular male sexual aid device of FIG. 1.
Figure 15:
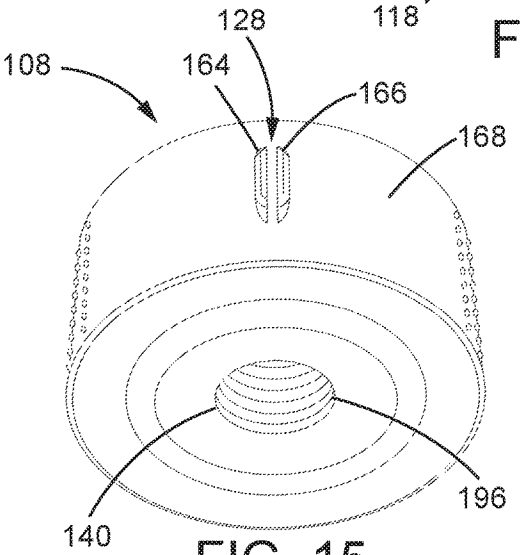
FIG. 15 is a perspective view of another ring segment of the modular male sexual aid device of FIG. 1.

Referring to FIG. 14, each ring segment 108, 142 includes an outer circumferential sidewall 168, a body 194, an inner circumferential sidewall 196, and a retention mechanism 198. The body 194 extends radially between the outer circumferential sidewall 168 and the inner circumferential sidewall 196.

In embodiments, at least one of the ring segments 108, 142 can include a textured gripping surface 134 extending radially outwards from the outer circumferential sidewall 168. In the illustrated embodiment, each of the ring segments 108,142 includes the textured gripping surface, which is configured to align with the textured gripping surface of the rings segments 108, 142 that are respectively adjacent thereto.

In embodiments, the body 194 includes an interior portion 114 and an exterior portion 118 with the interior portion 114 generally made of a softer material than the exterior portion 118. In embodiments, the inner circumferential sidewall 196 can be made of at least one of an elastomer—such as, a thermoplastic elastomer, for example—and an elastomeric gel.

The inner circumferential sidewall 196 defines a central passage 116, 140 extending along a ring axis R. Referring to FIG. 7, the ring segments 108 and the top ring segment 142 are configured such that the central passages 116, 140 of the ring segments 108, 142 are substantially aligned with each other when mounted to the housing 112 to define the masturbation passage 132. The masturbation passage 132 has an open end adjacent the top ends 122 of the pair of walls 104, 130 configured for performing a masturbating act.

In embodiments, the inner circumferential sidewall of at least one of the ring segments has at least one of a shape and a texture that is different from that of the other ring segments. For example, the inner circumferential sidewall 196 of the ring segment 108 can form different designs of different shapes and textures (see e.g. FIGS. 14-16 and 20).

In embodiments, the inner circumferential sidewall 196 of the plurality of rings segments 108, 142 can have the same shapes and textures, or designs. Alternatively, as shown in FIG. 7, the inner circumferential sidewall 196 of the plurality of rings segments 108, 142 can each have a shape, design, and/or texture different from that of at least one other ring segment 108, 142. For example, the inner circumferential sidewall 196 of a first of the three ring segments 108 forms a first design 144. The central passage 140 of a second of the three ring segments 108 forms a second design 146. The central passage 140 of a third of the three ring segments 108 forms a third design 148. The central passage 116 of the top ring segment 142 forms a fourth design 150. In embodiments, the different designs can be configured to allow a user of the modular male sexual aid device 100 to customize the arrangement of the ring segments 108 such that the user can experience varying sensations.

Figure 25:
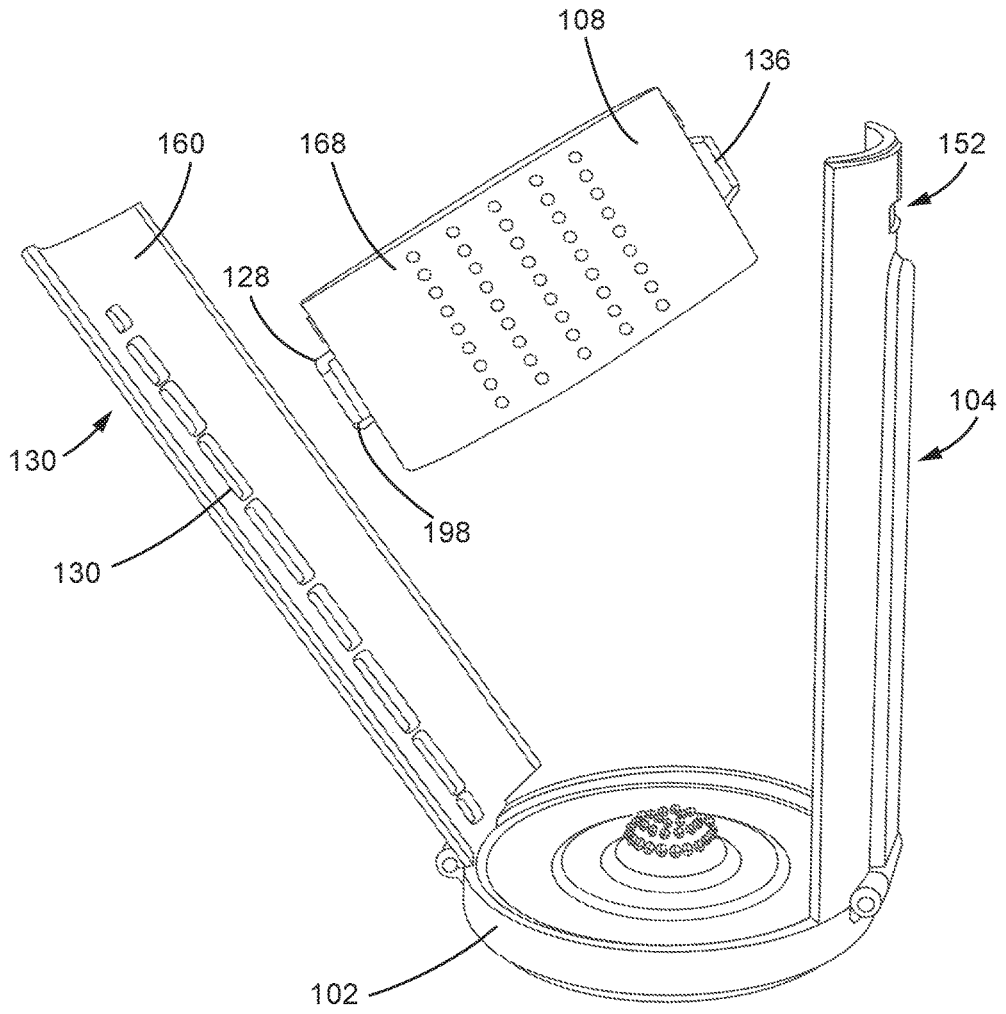
FIG. 25 is an exploded view of the housing and one of the ring segments of the modular male sexual aid device of FIG. 1.
Figure 26:
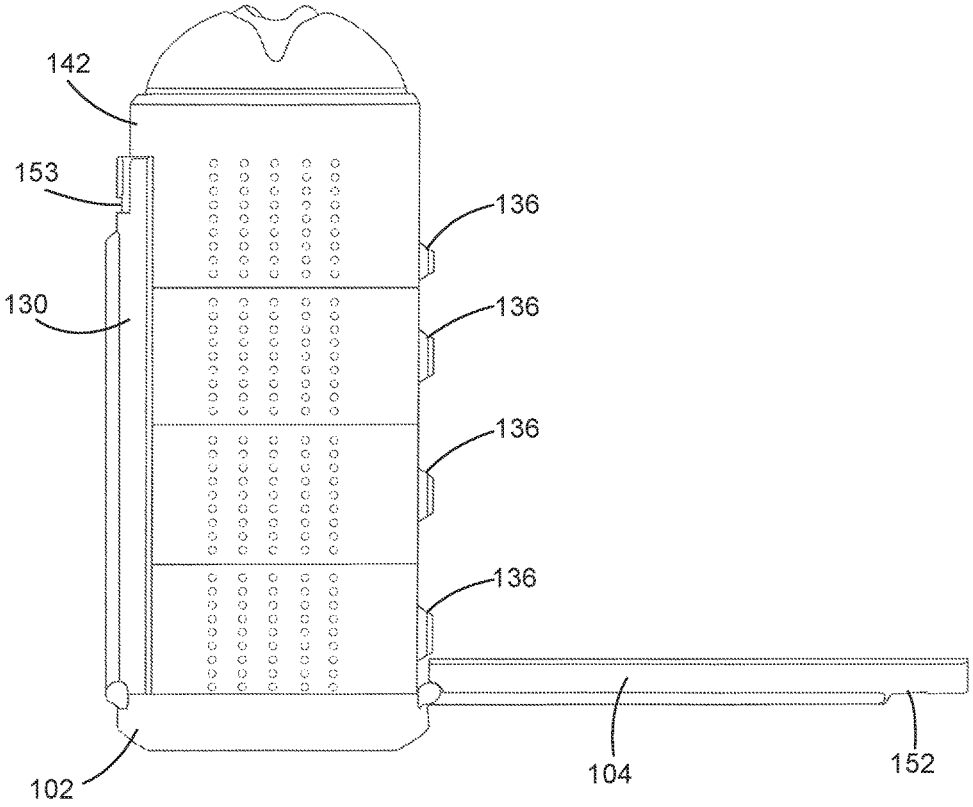
FIG. 26 is a front elevational view of the housing and the ring segment of the modular male sexual aid device of FIG. 1, illustrating these components in a partially-assembled condition and showing the first wall of the housing in an upright position and the other wall of the housing in a prone position outwardly extended from the base.

In embodiments, each ring segment includes at least one retention mechanism that is adapted to retentively engage one of the retention pockets of the housing to removably mount the respective ring segment to the housing. As shown in FIG. 25, the retention mechanism 198 is adapted to retentively engage the housing 112 to removably mount the respective ring segment 108, 142 to the retention pockets 154 of the housing 112. The retention mechanism 198 extends outward radially from the outer circumferential sidewall 168.

Figure 8:
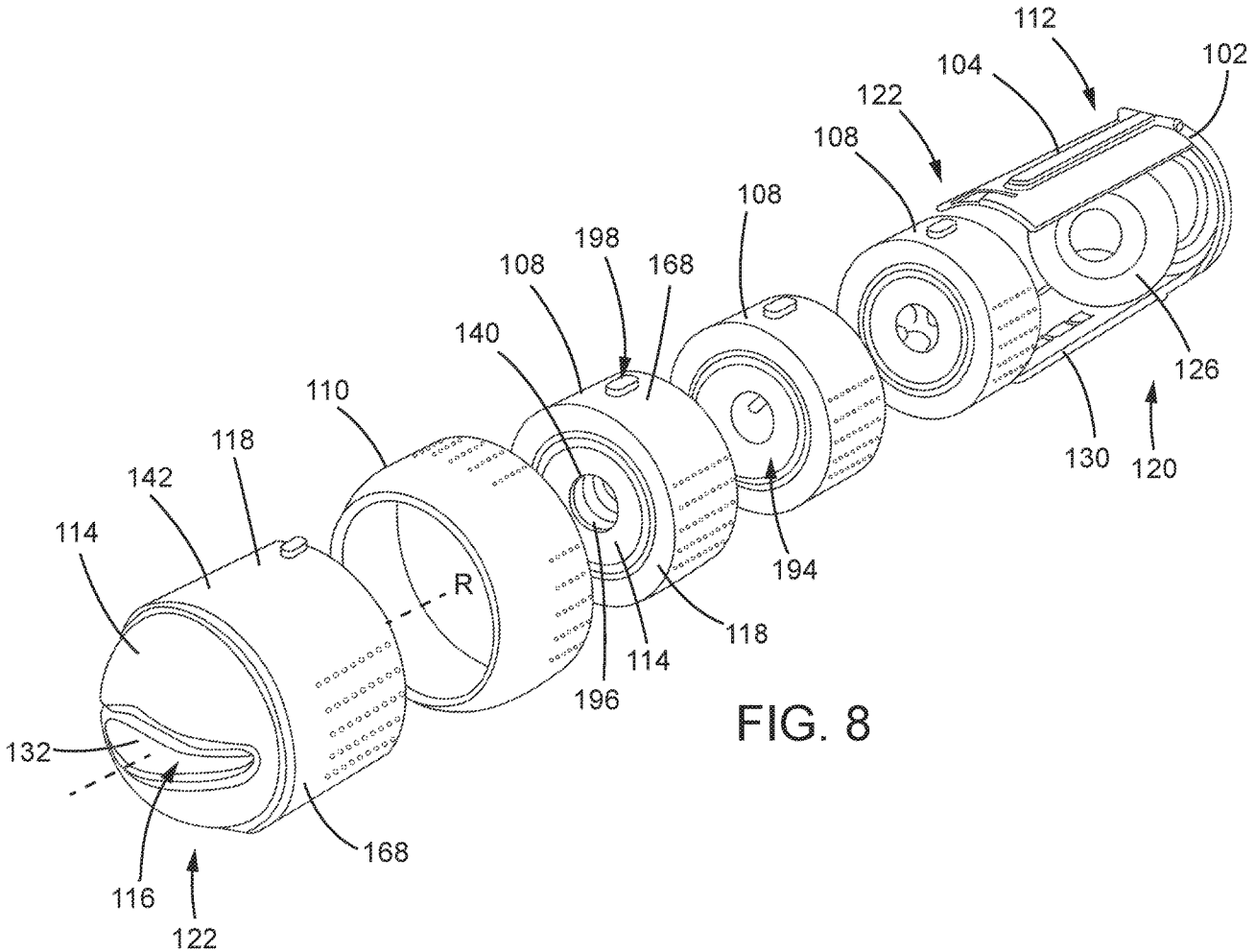
FIG. 8 is an exploded view, in perspective, of the modular male sexual aid device of FIG. 1.

Referring to FIG. 8, the male modular sexual aid device 100 is shown in an exploded view. In embodiments, the ring segments 108, 142 are removably mounted to the housing 112 by the respective retention mechanisms 198 such that the central passages 116, 140 of the ring segments 108, 142 are substantially aligned with each other to define the masturbation passage 132. In embodiments, the number of ring segments 108, 142 and/or the size and/or shape of at least one of the ring segments 108, 142 can be varied to produce a variety of other possible masturbation passages that a user can assemble. In embodiments, the axial length and the radial area of the masturbation passage can be varied by using different ring segments 108, 142.

In embodiments, the masturbation passage 132 has an open end adjacent the top ends 122 of the walls 104, 130 and is configured for performing a masturbating act. In embodiments, the interior portion 114 of the top ring segment 142 can extend past a top end 186 of the end cap 110. In embodiments, the body 194 can define a shape simulating a human orifice. For example, in embodiments, the top ring segment 142 can define an orifice that simulates at least one of labial lips of a vagina passage, an anus of a rectum passage, and a mouth with lips of a throat passage.

Figure 17:
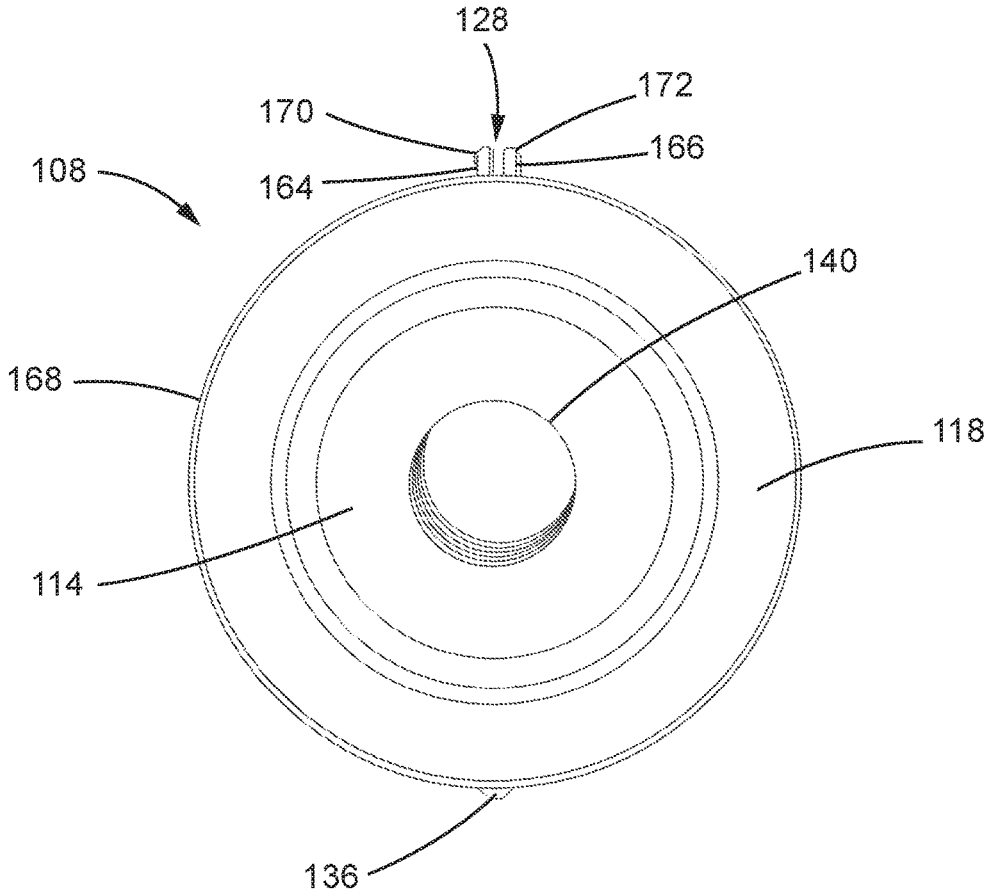
FIG. 17 is a top perspective view of the ring segment of FIG. 15.
Figure 18:
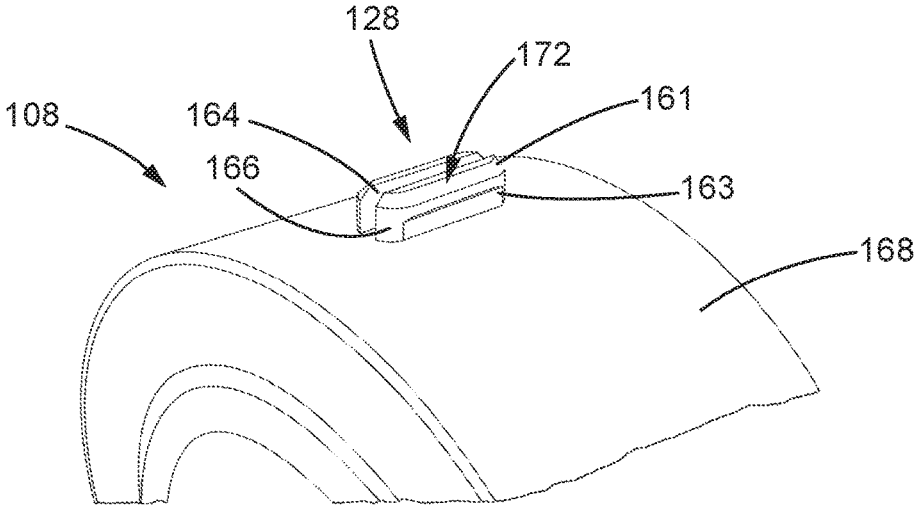
FIG. 18 is an enlarged, detail view of a retention mechanism of the ring segment of FIG. 15.

The outer circumferential sidewall 168 of the ring segment 108 forms a retention mechanism 198, for example, a resiliently flexible retaining finger 128. FIGS. 17 and 18 show an example of the retaining finger 128. The retaining finger 128 extends from the outer circumferential sidewall 168 of the ring segment 108 and comprises a first finger 164 and a second finger 166. The first finger 164 is in spaced relationship with the second finger 166. Both the first finger 164 and the second finger 166 include a respective distal head 170, 172. Each distal head 170, 172 has a beveled guide surface 161 and a retention shoulder 163. The retaining finger 128 is configured to snap into the retaining pocket 154 of the housing 112 via the distal head 170, 172. The beveled guide surface 161 is in distal relationship to the retention shoulder 163. The retention shoulders 163 project outwardly from the respective retention finger 128 and are adapted to retentively engage the respective pair of pocket sidewall surface 165 to removably mount the respective ring segment 108, 142 to the housing 112.

In embodiments, as shown in FIG. 17, each ring segment 108, 142 also includes a support projection 136 extending radially outwardly from the outer circumferential sidewall 168. In embodiments, the retaining finger 128 can be in opposing relationship to the support projection 136 about the outer circumferential sidewall 168. The support projection 136 is configured such that, when the retention mechanism 198 is retentively engaged with one of the retention pockets 154, the support projection 136 is disposed within, and supported by, the associated indexing recess 159 of the housing 112.

Figure 19:
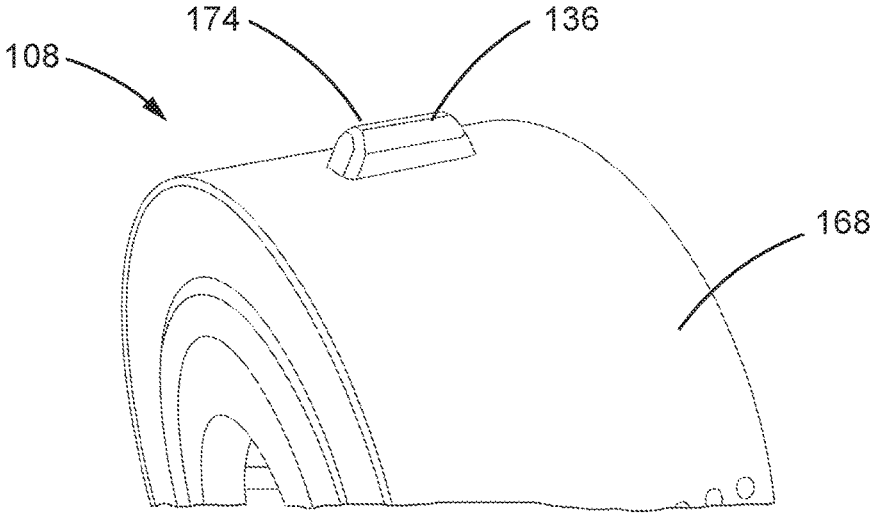
FIG. 19 is an enlarged, detail view of a support projection of the ring segment of FIG. 15.
Figure 20:
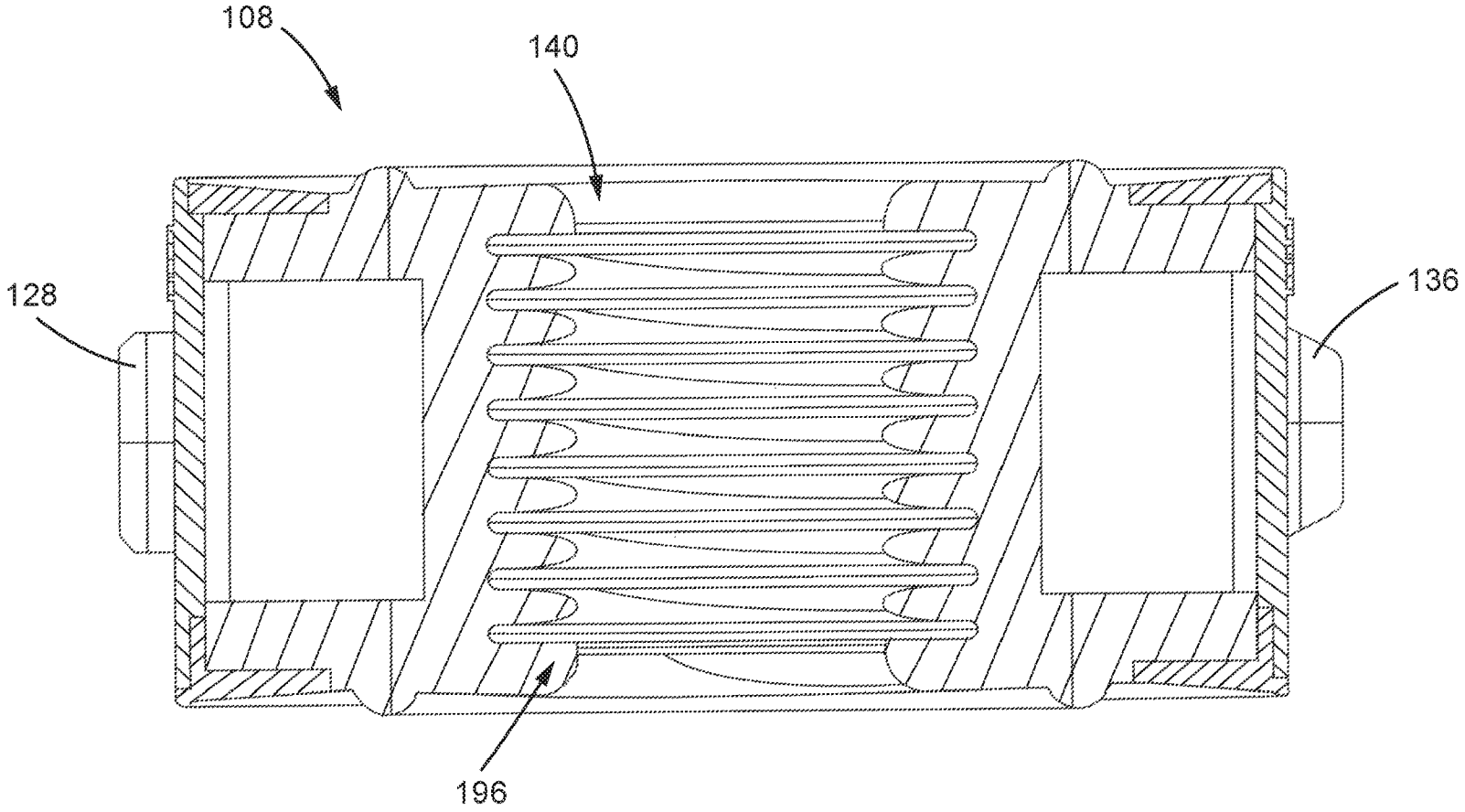
FIG. 20 is a longitudinal sectional view of the ring segment of FIG. 15.

FIG. 19 shows an example of the support projection 136. The support projection 136 extends from the outer circumferential sidewall 168 of the ring segment 108 and is configured to rest within a retention pocket 154 of the housing 112 such that the other wall of the housing 112 can help support the ring segments 108, 142. The support projection 136 can be chamfered near the top end 174. In embodiments, the retention mechanisms, the support projections, and the respective recesses of the housing configured to receive these support elements therein are configured such that each of the ring segments 108 can be mounted to the housing 112 in one of at least two different positions.

While FIGS. 14-16 and 20 show the ring segment 108, it should be appreciated that the description of the retention mechanism 198, such as the retaining finger 128, and the support projection 136, for example, is applicable to the top ring segment 142 as well.

Figure 21:
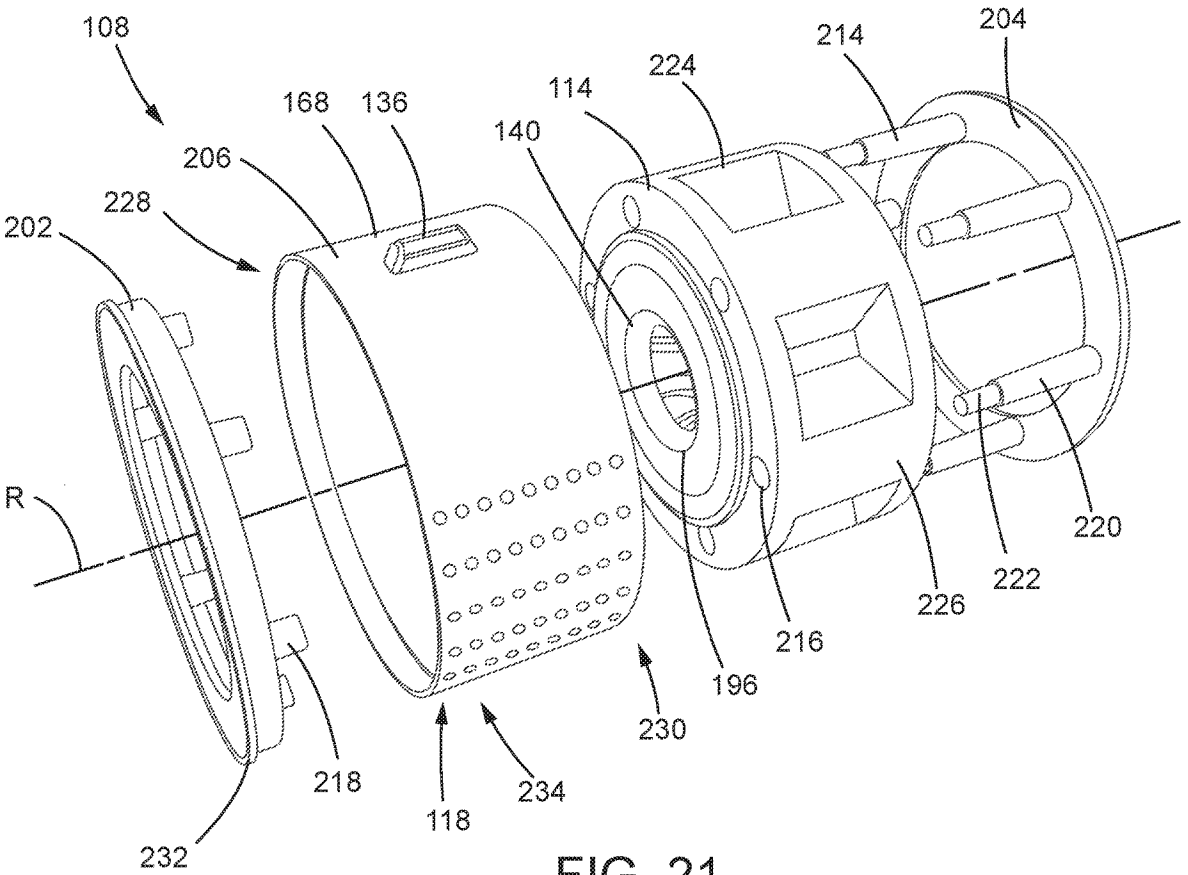
FIG. 21 is an exploded view of the ring segment of FIG. 15.

Referring to FIG. 21, one of the ring segments 108 is shown in an exploded view. It should be understood that the other ring segments 108, 142 can have a similar construction. The ring segment 108 can include an inner portion 114 and a pair of end caps 202, 204. In the illustrated embodiment, the inner portion 114 includes the majority of the body 194 and the inner circumferential sidewall 196. The inner portion 114 defines a plurality of axial passages 216 that extend along the ring axis R and are substantially parallel to the central passage 140 and are circumferentially arranged about the central passage 140. The inner portion 114 can define a plurality of body recesses 224 disposed circumferentially about an outer periphery 226 of the inner portion 114 and extending radially inward from the outer periphery 226 toward the central passage 210. The body recesses 224 are generally disposed circumferentially between adjacent axial passages 216.

In embodiments, the ring segment 108 includes a support frame 234. The support frame 234 can include the outer circumferential wall 168 and the retention mechanism 198. In the illustrated embodiment, the support frame 234 can include the outer circumferential sidewall 168, the retention mechanism 198, the support projection 136, and the end caps 202, 204. The end caps 202, 204 are both generally annular and are configured to be respectively mounted to a first end 228 and a second end 230 of the outer circumferential sidewall. The first end 228 is configured to abut the top cap 202, and the second end 230 is configured to abut the bottom cap 204. A plurality of rods 214 is circumferentially arranged about the bottom cap 204. Each rod 214 has a bottom portion 220 and a top portion 222. The bottom portion 220 has a diameter greater than a diameter of the top portion 222. The plurality of rods 214 are configured to respectively pass through the axial passages 216 of the inner portion 114. A plurality of sockets 218 are circumferentially disposed about the periphery of the top cap 202. The plurality of sockets 218 are positioned such that the top portions 222 of the plurality of rods 214 can respectively extend through the plurality of axial passages 216 of the inner portion 114 and be retentively engaged within the plurality of sockets 218.

In embodiments, the support frame 234 can be made from a first material, and the inner portion 114—which can include the inner circumferential sidewall 196 and at least a portion of the body 194—is made from a second material that is different from the first material. In embodiments, the second material can be more flexible than the first material. In embodiments, the inner portion 114, which includes the inner circumferential sidewall 196 and at least a portion of the body 194, is made from at least one of an elastomer and an elastomeric gel.

Figure 28:
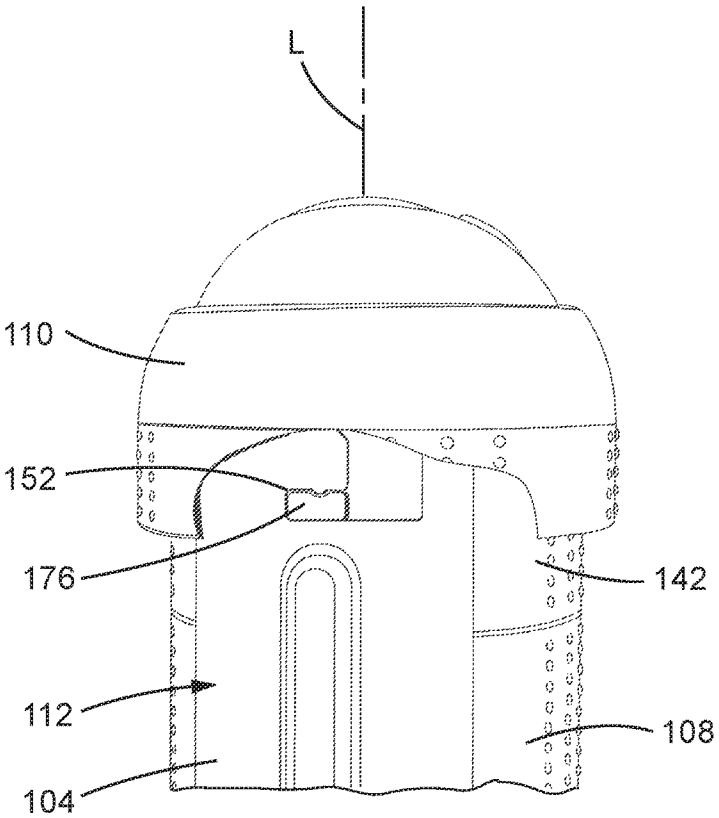
FIG. 28 is a view, as in FIG. 27, but illustrating the end cap in a locked position.
Figure 27:
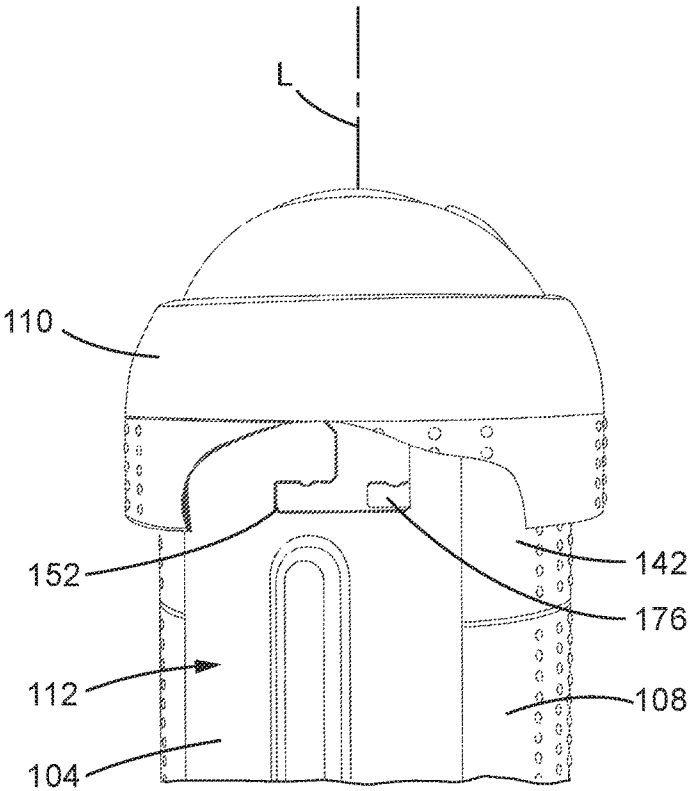
FIG. 27 is an enlarged, detail view of the end cap, partially broken away, of the modular male sexual aid device of FIG. 1, illustrating the end cap in a partially-assembled position.

As shown in FIGS. 27 and 28, the end cap 110 is removably connected to the top ends 122 of the walls 104, 130 of the housing 112. In the illustrated embodiment, the top ends 122 of the walls 104, 130 are disposed within the end cap 110. The end cap 110 is generally ring-shaped and can be formed of any suitable material.

When mounted to the housing 112, the end cap 110 can prevent the pair of walls 104, 130 from moving about their respective hinged axis with respect to the base 102, thereby securing the plurality of ring segments 108, 142 within the housing 112. When the end cap 110 is removed from the housing 112, the pair of walls 104, 130 can move from the upright position to a prone position. In the upright position, the walls 104, 130 are substantially perpendicular with respect to the base 102. In a prone position, the walls 104, 130 extend outwardly from the base 102.

Figure 3:
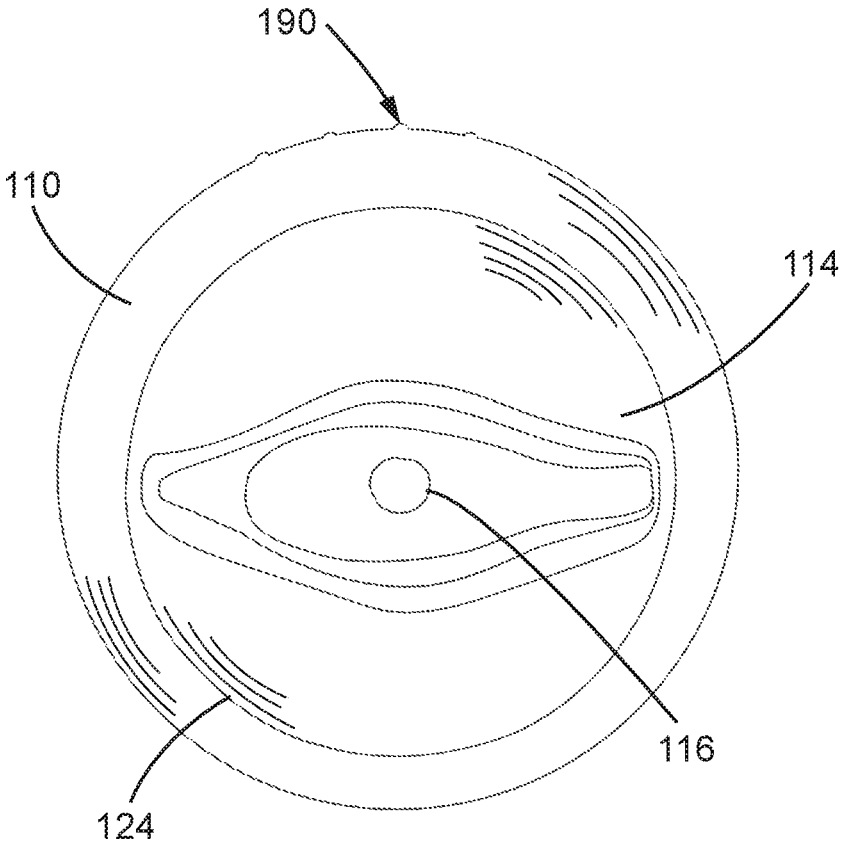
FIG. 3 is a top plan view of the modular male sexual aid device of FIG. 1.
Figure 22:
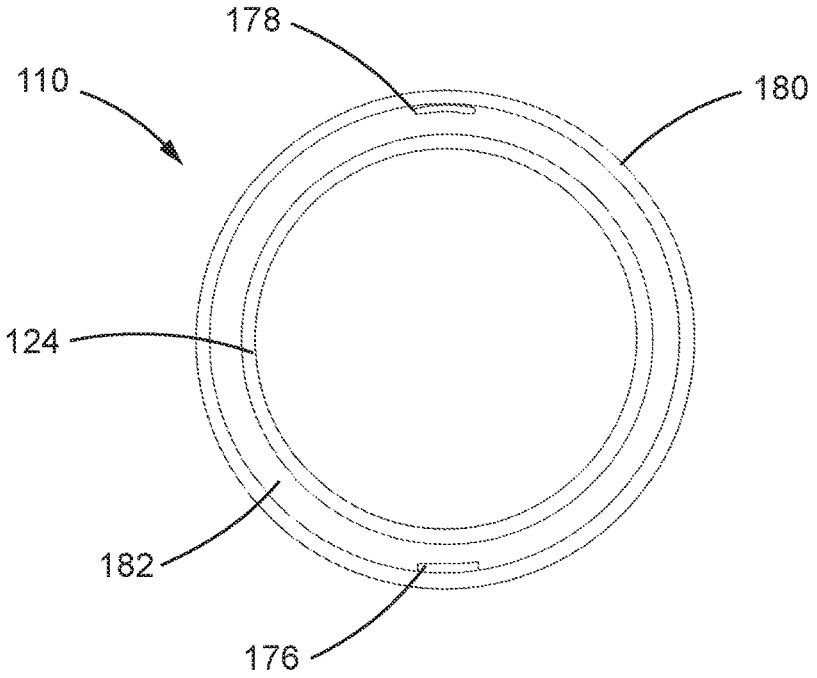
FIG. 22 is a bottom plan view of an end cap of the modular male sexual aid device of FIG. 1.
Figure 23:
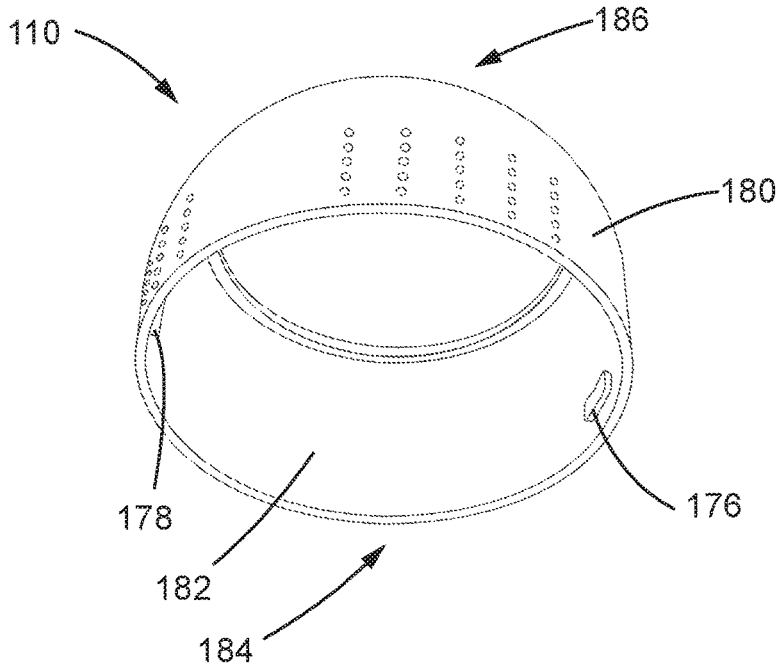
FIG. 23 is a bottom perspective view of the end cap of FIG. 22.
Figure 24:
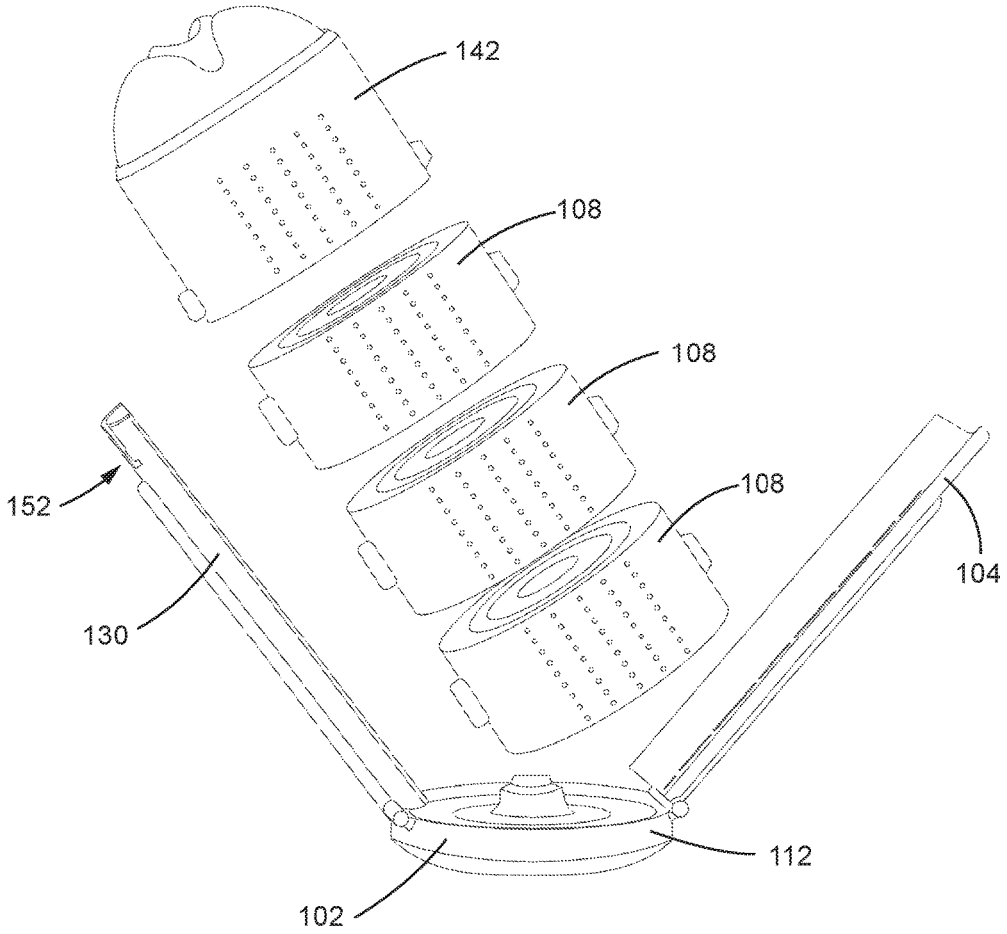
FIG. 24 is an exploded view of the housing and the ring segments of the modular male sexual aid device of FIG. 1.

FIGS. 22-23 show, for example, a dome shaped end cap 110. The end cap 110 forms a central opening 124 such that the interior portion 114 of the top ring segment 142 is partially exposed (see, e.g. FIG. 3). An outside surface 180 of the end cap 110 can form a textured gripping surface 190.

In embodiments, the end cap 110 includes at least one retention lug adapted to retentively engage the housing 112 to help retain the end cap in a mounted relationship with respect to the housing 112. In the illustrated embodiment, the end cap 110 includes a first retention lug 176 and a second retention lug 178. The first and second retention lugs 176, 178 can be in opposing relationship to each other and can be disposed near a bottom end 184 of the end cap 110. The first and second retention lugs can project radially inward from an inside surface 182 of the end cap 110. It should be understood that the description of one retention lug is applicable to the other retention lug, as well. In embodiments, the end cap 110 can include a single retention lug disposed near the bottom end 184 of the end cap 110.

FIG. 27 shows the end cap 110 in an unlocked position, and FIG. 28 shows the end cap 110 in a locked position. The lug raceway 152 is configured to removably receive the first retention lug 176 therein such that the retention lug 176 and the retention surface 167 are in interfering relationship with each other to removably mount the end cap 110 to the housing 112 such that the top ends 122 of the pair of walls 104, 130 are disposed within the end cap 110. In the unlocked position, the first retention lug 176 of the end cap 110 is received by, and lies within, the lug raceway 152 at the top end 122 of the first wall 104. A force on the end cap 110 along the longitudinal axis L away from the lug raceway 152 separates the end cap 110 from the housing 112. In the locked position, the first retention lug 176 is received by, and lies within, the lug raceway 152 and the end cap 110 is rotated about the longitudinal axis L such that a force on the end cap 110 along the longitudinal axis L away from the lug raceway 152 does not separate the end cap 110 from the housing 112. In other embodiments, the end cap 110 can be removably mounted to the housing 112 via another suitable technique, such as via a threaded connection or a press fit connection, for example.

In embodiments of a method of assembling a modular male sexual aid device following principles of the present disclosure, a modular male sexual aid device can be assembled that is constructed according to principles of the present disclosure. In embodiments, a method of assembling a modular male sexual aid device following principles of the present disclosure can be used to assemble any embodiment of a sexual aid device according to principles discussed herein.

Figure 29:
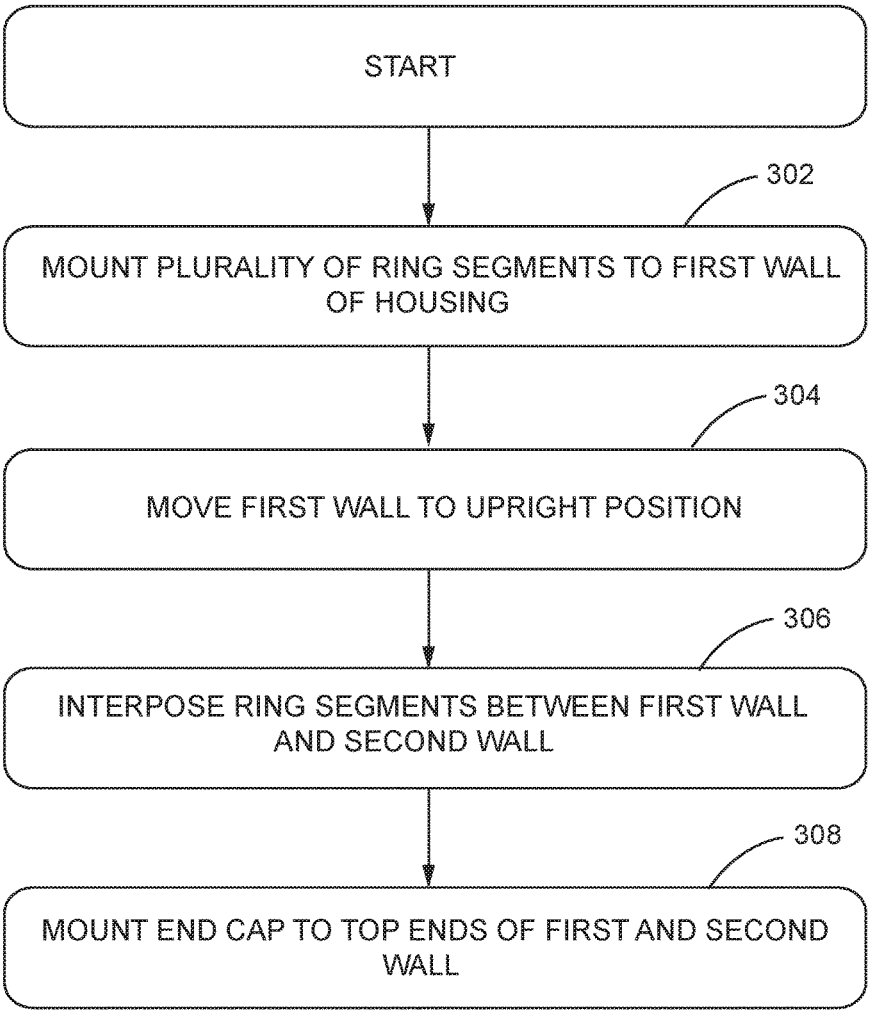
FIG. 29 is a flowchart illustrating steps of an embodiment of a method of assembling a modular male sexual aid device following principles of the present disclosure.

Referring to FIG. 29, steps of an embodiment of a method of assembling a modular male sexual aid device following principles of the present disclosure are shown. The method under consideration includes removably mounting a plurality of ring segments to a first wall of a housing at step 302. Each ring segment defines a central passage extending along a ring axis. At step 304, the first wall is pivotally moved to an upright position in with the first wall is in substantially perpendicular relationship with the base. The first wall is positioned with respect to a second wall of the housing such that the ring segments are interposed between the first wall and the second wall at step 306. At step 308, the end cap is removably mounted to top ends of the first and second wall such that the first wall is prevented from rotating outwardly with respect to the second wall. The central passages of the ring segments are substantially aligned with each other to define a masturbation passage. The masturbation passage has an open end adjacent the top ends of the walls and is configured for performing a masturbating act.

In embodiments, positioning the first wall with respect to the second wall of the housing includes placing the ring segments into contacting engagement with the second wall such that the first and second walls both support each ring segment. In embodiments, before mounting the end cap to the top ends of the first and second walls, the second wall is pivotally moved from a prone position in which the second wall extends outwardly from the base to an upright position in which the second wall is in substantially perpendicular relationship with the base.

In embodiments, the central passage of at least one of the ring segments is defined by a surface having at least one of a shape and a texture that is different from that of the other ring segments. In at least some of such embodiments, the method includes arranging the ring segments in a selected axial order along the masturbation passage. In embodiments, the end cap can be removed from the top ends of the housing and at least the first wall can be pivoted outwardly from the base to a prone position. In embodiments, the axial order of the ring segments can be changed. In other embodiments, at least one ring segment can be removed from the housing and replaced by another ring segment that has at least one of a shape and a texture that is different from that of the ring segment which it is replacing. The first wall can be returned to the upright position, and the end cap can be mounted to the top ends of the first and second walls such that the first wall is prevented from rotating outwardly with respect to the second wall with the ring segments interposed between the first and second walls.

All references, including publications, patent applications, and patents, cited herein are hereby incorporated by reference to the same extent as if each reference were individually and specifically indicated to be incorporated by reference and were set forth in its entirety herein.

The use of the terms "a" and "an" and "the" and similar referents in the context of describing the invention (especially in the context of the following claims) are to be construed to cover both the singular and the plural, unless otherwise indicated herein or clearly contradicted by context. The terms "comprising," "having," "including," and "containing" are to be construed as open-ended terms (i.e., meaning "including, but not limited to,") unless otherwise noted. Recitation of ranges of values herein are merely intended to serve as a shorthand method of referring individually to each separate value falling within the range, unless otherwise indicated herein, and each separate value is incorporated into the specification as if it were individually recited herein. All methods described herein can be performed in any suitable order unless otherwise indicated herein or otherwise clearly contradicted by context. The use of any and all examples, or exemplary language (e.g., "such as") provided herein, is intended merely to better illuminate the invention and does not pose a limitation on the scope of the invention unless otherwise claimed. No language in the specification should be construed as indicating any non-claimed element as essential to the practice of the invention.

Preferred embodiments of this invention are described herein, including the best mode known to the inventors for carrying out the invention. Variations of those preferred embodiments may become apparent to those of ordinary skill in the art upon reading the foregoing description. The inventors expect skilled artisans to employ such variations as appropriate, and the inventors intend for the invention to be practiced otherwise than as specifically described herein. Accordingly, this invention includes all modifications and equivalents of the subject matter recited in the claims appended hereto as permitted by applicable law. Moreover, any combination of the above-described elements in all possible variations thereof is encompassed by the invention unless otherwise indicated herein or otherwise clearly contradicted by context.

What is claimed is:

1. A modular male sexual aid device comprising:

a housing, the housing including a base and a pair of walls, each of the walls extending longitudinally between a bottom end and a top end, the bottom ends of the walls being connected to the base, wherein one of the walls includes an interior wall surface defining a plurality of retention pockets along the interior wall surface;

a plurality of ring segments, each ring segment having an outer circumferential sidewall, a body, an inner circumferential sidewall, and a retention mechanism, the body extending radially between the outer circumferential sidewall and the inner circumferential sidewall, the inner circumferential sidewall defining a central passage extending along a ring axis, and the retention mechanism extending outward radially from the outer circumferential sidewall, the retention mechanism being adapted to retentively engage one of the retention pockets of the housing to removably mount the ring segment to the housing; and an end cap, the end cap removably connected to the top ends of the walls of the housing;

wherein the ring segments are removably mounted to the housing by the retention mechanisms such that the central passages of the ring segments define a masturbation passage, the masturbation passage having an open end adjacent the top ends of the walls and being configured for performing a masturbating act.

2. The modular male sexual aid device according to claim 1, wherein at least one of the bottom ends of the walls is hingedly connected to the base such that such wall, when the end cap is removed from the housing, is pivotally movable over a range of travel about a hinge axis between an upright position with respect to the base and a prone position in which said wall extends outwardly from the base.

3. The modular male sexual aid device according to claim 2, wherein the walls of the housing are both hingedly connected to the base such that each wall, when the end cap is removed from the housing, is pivotally movable about the respective hinge axis between the upright position and the prone position.

4. The modular male sexual aid device according to claim 3, wherein the bottom ends of the walls are connected to the base such that the walls are in opposing relationship to each other about the base.

5. The modular male sexual aid device according to claim 4, wherein the other of the walls includes an interior wall surface defining a plurality of indexing recesses, the indexing recesses being in regular, spaced relationship to each other along the interior wall surface of the other of the walls such that the indexing recesses are respectively aligned with the retention pockets of the one wall, and wherein each of the ring segments includes a support projection, the support projection being configured such that, when the retention mechanism is retentively engaged with one of the retention pockets, the support projection is disposed within, and supported by, one of the indexing recesses of the housing.

6. The modular male sexual aid device according to claim 2, wherein the other of the walls includes an interior wall surface defining a plurality of indexing recesses, the indexing recesses being in regular, spaced relationship to each other along, the interior wall surface of the other of the walls such that the indexing recesses are respectively aligned with the retention pockets of the one wall, and wherein each of the ring segments includes a support projection, the support projection being configured such that, when the retention mechanism is retentively engaged with one of the retention pockets, the support projection is disposed within, and supported by, the associated indexing recess of the housing.

7. The modular male sexual aid device according to claim 2, wherein the inner circumferential sidewall of at least one of the ring segments has at least one of a shape and a texture that is different from that of the other ring segments.

8. The modular male sexual aid device according to claim 1, wherein the inner circumferential sidewall of at least one of the ring segments has at least one of a shape and a texture that is different from that of the other ring segments.

9. The modular male sexual aid device according to claim 1, wherein each ring segment includes a support frame, the support frame made from a first material, the support frame including the outer circumferential wall and the retention mechanism, and the inner circumferential wall and at least a portion of the body being made from a second material, the second material being more flexible than the first material.

10. The modular male sexual aid device according to claim 9, wherein the inner circumferential sidewall and said at least a portion of the body are made from at least one of an elastomer and an elastomeric gel.

11. The modular male sexual aid device according to claim 1, wherein the retention mechanism of each ring segment includes a pair of resiliently flexible retention fingers, the retention fingers being disposed in spaced relationship to each other and projecting radially outwardly from the outer circumferential sidewall, the retention fingers being configured to retentively engage a portion of the interior wall surface defining at least one of the retention pockets.

12. The modular male sexual aid device according to claim 11, wherein each of the retention pockets of the housing includes a pair of pocket sidewall surfaces in opposing relationship to each other, and wherein the retention fingers of each retention mechanism each includes a distal head, the distal head including a beveled guide surface and a retention shoulder, the beveled guide surface in distal relationship to the retention shoulder, the retention shoulders projecting outwardly from the respective retention finger and adapted to retentively engage a respective pocket sidewall surface to removably mount the respective ring segment to the housing.

13. The modular male sexual aid device according to claim 1, wherein the body of one of the ring segments has a shape simulating a human orifice.

14. The modular male sexual aid device according to claim 1, wherein the outer circumferential sidewall of at least one of the ring segments has a textured gripping surface.

15. The modular male sexual aid device according to claim 1, wherein the end cap includes a retention lug, and wherein one of the walls includes an exterior wall surface having a retention surface at the top end, the retention surface defining a lug raceway, the lug raceway being configured to removably receive the retention lug therein such that the retention lug and the retention surface are in interfering relationship with each other to removably mount the end cap to said wall such that the top ends of the walls are disposed within the end cap.

16. A modular male sexual aid device comprising:

a housing, the housing including a base and a pair of walls, each of the walls extending longitudinally between a bottom end and a top end, the bottom ends of the walls being pivotally connected to the base, the walls in opposing relationship to each other about the base;

a plurality of ring segments, each ring segment defining a central passage extending along a ring axis, and each ring segment being removably connected to one of the walls of the housing such that the central passages of the ring segments define a masturbation passage; and an end cap, the end cap removably connected to the top ends of the walls such that the walls are prevented from rotating outwardly away from each other;

wherein, when the end cap is removed from the housing, the walls are each pivotally movable over a range of travel about a respective hinge axis between an upright position with respect to the base and a prone position in which said wall extends outwardly from the base.

17. A method of assembling a modular male sexual aid device comprising:

removably mounting a plurality of ring segments to a first wall of a housing, each ring segment defining a central passage extending along a ring axis;

pivotally moving the first wall to an upright position with respect to a base of the housing;

positioning the first wall with respect to a second wall of the housing such that the ring segments are interposed between the first wall and the second wall;

removably mounting an end cap to top ends of the first and second walls such that the first wall is prevented from rotating outwardly with respect to the second wall;

wherein the central passages of the ring segments are substantially aligned with each other to define a masturbation passage, the masturbation passage having an open end adjacent the top ends of the walls and being configured for performing a masturbating act.

18. The method of claim 17, wherein positioning the first wall with respect to the second wall of the housing includes placing the ring segments into contacting engagement with the second wall such that the first and second walls both support each ring segment.

19. The method of claim 17, wherein the central passage of at least one of the ring segments is defined by a surface having at least one of a shape and a texture that is different from that of the other ring segments, the method further comprising:

arranging the ring segments in a selected axial order along the masturbation passage.

20. The method of claim 17, further comprising:

before mounting the end cap to the top ends of the first and second walls, pivotally moving the second wall to an upright position with respect to the base.

* * * * *